US009152090B2

(12) United States Patent
Yoshida

(10) Patent No.: US 9,152,090 B2
(45) Date of Patent: Oct. 6, 2015

(54) IMAGE FORMING APPARATUS THAT SUPPRESSES DETERIORATION IN IMAGE QUALITY

(71) Applicant: Ken Yoshida, Kanagawa (JP)

(72) Inventor: Ken Yoshida, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 77 days.

(21) Appl. No.: 13/945,365

(22) Filed: Jul. 18, 2013

(65) Prior Publication Data

US 2014/0023388 A1 Jan. 23, 2014

(30) Foreign Application Priority Data

Jul. 20, 2012 (JP) ..... 2012-161628
Oct. 12, 2012 (JP) ..... 2012-227246
Dec. 19, 2012 (JP) ..... 2012-276480

(51) Int. Cl.
*G03G 15/16* (2006.01)
*G03G 15/14* (2006.01)

(52) U.S. Cl.
CPC ..... *G03G 15/14* (2013.01); *G03G 15/1665* (2013.01); *G03G 2215/0129* (2013.01); *G03G 2215/0164* (2013.01); *G03G 2215/0193* (2013.01)

(58) Field of Classification Search
CPC ..... G03G 15/14; G03G 15/1665; G03G 2215/0129; G03G 2215/0164; G03G 2215/0193
USPC ..... 399/66, 101, 121
See application file for complete search history.

(56) References Cited

U.S. PATENT DOCUMENTS

| | | | |
|---|---|---|---|
| 5,532,799 | A * | 7/1996 | Watanabe et al. |
| 5,729,788 | A | 3/1998 | Hirohashi et al. |
| 6,804,479 | B2 * | 10/2004 | Kimura |
| 2004/0136760 | A1 | 7/2004 | Yoshida et al. |
| 2004/0218944 | A1 * | 11/2004 | Kawaguchi et al. |
| 2005/0013636 | A1 | 1/2005 | Sawai et al. |
| 2005/0147424 | A1 | 7/2005 | Kato et al. |
| 2005/0254853 | A1 | 11/2005 | Yoshida |
| 2006/0245782 | A1 | 11/2006 | Hirai et al. |
| 2007/0127960 | A1 | 6/2007 | Yoshida |

(Continued)

FOREIGN PATENT DOCUMENTS

| | | |
|---|---|---|
| JP | 08-248787 | 9/1996 |
| JP | 10-083124 | 3/1998 |

(Continued)

*Primary Examiner* — Walter L Lindsay, Jr.
*Assistant Examiner* — Milton Gonzalez
(74) *Attorney, Agent, or Firm* — Oblon, McClelland, Maier & Neustadt, L.L.P.

(57) ABSTRACT

An image forming apparatus includes: an image carrier; a transfer member arranged so as to face the image carrier; and a non-transferred toner adhesion unit that causes a non-transferred toner to adhere to an inter-sheet area present on the image carrier during a period of continuous image formation in which images are continuously formed on the image carrier. The transfer member is a foam roller. The image forming apparatus further includes a contacting and separating unit that causes the foam roller and the image carrier to come into contact with and be separated from each other. The contacting and separating unit separates the image carrier and the transfer member when the inter-sheet area present on the image carrier passes through a transfer area in which the image carrier and the transfer member face each other in association with rotation of the image carrier.

9 Claims, 17 Drawing Sheets

(56) References Cited

U.S. PATENT DOCUMENTS

| | | | |
|---|---|---|---|
| 2007/0134014 | A1 | 6/2007 | Kato et al. |
| 2007/0201893 | A1 * | 8/2007 | Yamazaki |
| 2007/0201922 | A1 * | 8/2007 | Takahashi |
| 2007/0242965 | A1 | 10/2007 | Akamatsu |
| 2007/0280748 | A1 | 12/2007 | Yoshida |
| 2008/0037038 | A1 * | 2/2008 | Arai |
| 2008/0088883 | A1 | 4/2008 | Yoshida |
| 2008/0279589 | A1 | 11/2008 | Muto et al. |
| 2009/0016784 | A1 | 1/2009 | Yoshida |
| 2009/0196661 | A1 | 8/2009 | Yoshida |
| 2010/0080631 | A1 | 4/2010 | Ogiyama et al. |
| 2010/0098446 | A1 | 4/2010 | Ishikawa et al. |
| 2010/0221029 | A1 | 9/2010 | Minbu et al. |
| 2010/0266300 | A1 | 10/2010 | Yoshida |
| 2011/0103810 | A1 | 5/2011 | Yoshida |
| 2011/0249992 | A1 | 10/2011 | Yoshida |
| 2012/0008991 | A1 | 1/2012 | Shimizu |
| 2012/0230706 | A1 | 9/2012 | Yoshida |
| 2012/0321357 | A1 | 12/2012 | Ogiyama et al. |
| 2013/0077984 | A1 | 3/2013 | Yoshida |

FOREIGN PATENT DOCUMENTS

| | | | |
|---|---|---|---|
| JP | 2001-305823 | | 11/2001 |
| JP | 2001-312154 | | 11/2001 |
| JP | 3460425 | | 8/2003 |
| JP | 2004-045457 | | 2/2004 |
| JP | 2005202115 | A * | 7/2005 |
| JP | 2006-220991 | | 8/2006 |
| JP | 2006-220998 | | 8/2006 |
| JP | 2007206475 | A * | 8/2007 |
| JP | 2007-286176 | | 11/2007 |
| JP | 4224761 | | 12/2008 |
| JP | 4372716 | | 9/2009 |
| JP | 4444678 | | 1/2010 |
| JP | 2010-204259 | | 9/2010 |
| JP | 2012-018369 | | 1/2012 |
| JP | 2012-198496 | | 10/2012 |

* cited by examiner

IMAGE FORMING APPARATUS THAT SUPPRESSES DETERIORATION IN IMAGE QUALITY

CROSS-REFERENCE TO RELATED APPLICATIONS

The present application claims priority to and incorporates by reference the entire contents of Japanese Patent Application No. 2012-161628 filed in Japan on Jul. 20, 2012, Japanese Patent Application No. 2012-227246 filed in Japan on Oct. 12, 2012 and Japanese Patent Application No. 2012-276480 filed in Japan on Dec. 19, 2012.

BACKGROUND OF THE INVENTION

1. Field of the Invention

The present invention relates to an image forming apparatus, such as a printer, a facsimile, and a copier.

2. Description of the Related Art

It is important for image forming apparatuses to make it possible to stably provide desired image density. For this reason, many image forming apparatuses form a density detection pattern made of a non-transferred toner not to be transferred onto a sheet, on an image carrier. The image forming apparatuses detect the image density of the density detection pattern with an optical detecting unit. Based on the detection result, the image forming apparatuses adjust image forming conditions (specifically, toner density, LD power, a charging bias, and a developing bias, for example), thereby performing density adjustment control for adjusting the amount of adhering toner to a target amount.

An image forming apparatus disclosed in Japanese Patent Application Laid-open No. 2001-305823 forms a density detection pattern in an inter-sheet area on an intermediate transfer belt serving as an image carrier. The inter-sheet area corresponds to a space between a trailing end of a preceding sheet and a leading end of a following sheet in continuous image formation. The image forming apparatus then detects the density detection pattern to perform density adjustment control. The image forming apparatus feeds a sheet into a secondary transfer area in which a secondary transfer member and the intermediate transfer belt face each other with the secondary transfer member brought into contact with the intermediate transfer belt to transfer an image formed on the intermediate transfer belt onto the sheet.

To prevent the sheet from being stained with a toner forming the density detection pattern, the density detection pattern formed in the inter-sheet area on the intermediate transfer belt is formed so as not to come into contact with the sheet in the secondary transfer area. Thus, no sheet is present in the secondary transfer area while the density detection pattern is passing through the secondary transfer area. As a result, the density detection pattern comes into contact with the secondary transfer member facing the intermediate transfer belt in the secondary transfer area. This causes the surface of the secondary transfer member to be stained with the toner forming the density detection pattern. If no countermeasure is taken, the toner adhering to the surface of the secondary transfer member adheres to the back of a sheet subsequently fed into the secondary transfer area, thereby causing a stain on the back of the sheet.

An image forming apparatus disclosed in Japanese Patent Application Laid-open No. 2001-312154 is provided with a cleaning device that cleans the surface of a secondary transfer roller serving as a secondary transfer member. The cleaning device includes a brush member or a blade member provided to be in contact with the surface of the secondary transfer roller. The image forming apparatus scrapes off and removes a toner adhering to the surface of the secondary transfer roller with the brush member or the blade member, thereby preventing a stain on the back of the sheet.

The density adjustment control may be performed at a timing after the power is turned ON or a timing after a print job is finished and with a regular interval. To stabilize the image density in continuous printing, the density adjustment control may be performed during a continuous print job (refer to Japanese Patent Application Laid-open No. 2001-312154). To perform the density adjustment control during a continuous print job, a density detection pattern is formed in an inter-sheet area on an intermediate transfer belt corresponding to a space between a trailing end of a preceding sheet and a leading end of a following sheet in the continuous printing.

In an image forming apparatus using an intermediate transfer method using an intermediate transfer belt, in order to improve the sheet adaptability and the accuracy of the image position, a density detection pattern formed on a photosensitive element is primarily transferred onto the intermediate transfer belt and then the density detection pattern on the intermediate transfer belt is detected to perform the density adjustment control.

The image forming apparatus using the intermediate transfer method feeds a sheet into a secondary transfer area between a secondary transfer roller serving as a secondary transfer member and the intermediate transfer belt to secondarily transfer an image formed on the intermediate transfer belt onto the sheet. To prevent the sheet on which the image is to be formed from being stained with a toner forming the density detection pattern, the density detection pattern formed in an inter-sheet area on the intermediate transfer belt is formed so as not to come into contact with the sheet in the secondary transfer area. Thus, no sheet is present in the secondary transfer area while the density detection pattern is passing through the secondary transfer area. As a result, the density detection pattern comes into contact with the secondary transfer roller facing the intermediate transfer belt in the secondary transfer area. This causes the secondary transfer roller to be stained with the toner forming the density detection pattern. If no countermeasure is taken, the toner adhering to the secondary transfer roller adheres to the back of a sheet subsequently fed into the secondary transfer area, thereby causing a stain on the back of the sheet.

To improve the performance for separating the sheet that passes through the secondary transfer area from the secondary transfer roller, a roller member with a relatively small diameter may be used as the secondary transfer roller. It is difficult, however, to clean the surface of such a thin roller member with the brush member or the blade member. Because a large amount of toner of the density detection pattern adheres to the surface of the secondary transfer roller, the cleaning device may possibly fail to sufficiently remove the toner adhering to the surface of the secondary transfer roller. As a result, the stain on the back of the sheet may possibly be caused.

An image forming apparatus disclosed in Japanese Patent Application Laid-open No. 2007-286176 separates a secondary transfer roller from an intermediate transfer belt while a density detection pattern formed in an inter-sheet area on the intermediate transfer belt is passing through a secondary transfer area. This causes the secondary transfer roller to be separated from the intermediate transfer belt in the inter-sheet area in which no sheet enters the secondary transfer area. As a result, the density detection pattern formed in the inter-sheet area on the intermediate transfer belt is prevented from adhering to the surface of the secondary transfer roller. This makes it possible to prevent a stain on the back of the sheet caused by the density detection pattern formed in the inter-sheet area on the intermediate transfer belt.

The stain on the back of the sheet caused by adhesion of the toner to the surface of the secondary transfer roller is not necessarily attributed to the density detection pattern formed in the inter-sheet area on the intermediate transfer belt. In recent years, there has been developed an image forming apparatus that performs what is called borderless printing for forming an image to an end of a sheet such that there is no margin at the edges of the entire perimeter of the sheet or any of the edges of the sheet (refer to Japanese Patent Application Laid-open No. 2004-45457). To form an image to an end of a sheet in borderless printing, a toner image simply needs to be formed on an intermediate transfer belt so as to be aligned with the position of the end of the sheet fed into a secondary transfer area. However, the formation of the toner image is difficult to carry out because not a little deviation occurs in the conveyance position of the sheet entering the secondary transfer area. Thus, the image forming apparatus disclosed in Japanese Patent Application Laid-open No. 2004-45457 forms an image on the intermediate transfer belt such that the image protrudes from the edge of the sheet.

Using a piece of thick paper as the sheet increases a shock of a collision of the sheet with the secondary transfer roller when the sheet is fed into the secondary transfer area in which the secondary transfer roller is brought into contact with the intermediate transfer belt compared with the case of using a piece of thin paper. The shock causes large vibration on the secondary transfer roller, and the vibration is transmitted to a photosensitive element in an image forming unit and an exposing device. As a result, a position at which the exposing device writes a latent image on the photosensitive element may possibly deviate from a normal position, resulting in deterioration in image quality.

The inventors of the present application conducted earnest research and found the following. Using a foam roller obtained by covering a cored bar with foam as the secondary transfer roller enables the foam to mitigate a shock of a collision of a sheet with the foam roller. This reduces vibration caused by the collision, thereby suppressing the deterioration in image quality.

However, a plurality of holes are formed on the surface of the foam roller, thereby making it difficult to physically remove a toner entering the holes with a brush or a blade. Thus, if the surface of the foam roller is stained with the toner forming the density detection pattern, the brush member or the blade member of the cleaning device fails to sufficiently remove the toner from the surface of the foam roller. As a result, the stain on the back of the sheet is caused.

While the explanation has been made of the stain on the back of the sheet made in the case where the density detection pattern is formed in the inter-sheet area on the intermediate transfer belt to perform density adjustment control, the non-transferred toner not to be transferred onto the sheet is not necessarily attributed to the density detection pattern. Examples of adhesion of the non-transferred toner to the inter-sheet area on the image carrier may include forcible ejection of a toner in a developing unit to the inter-sheet area on the image carrier to replace a deteriorated toner in the developing unit by a new toner. In this case as well, problems similar to those described above occur.

Forming an image so as to protrude from an edge of a sheet causes a toner protruding from the edge of the sheet to adhere to the intermediate transfer belt. The protruding toner adheres from the intermediate transfer belt to the surface of the secondary transfer roller when the image is transferred from the intermediate transfer belt onto the sheet in the secondary transfer area. As a result, the toner adhering to the secondary transfer roller adheres to the back of a sheet subsequently fed into the secondary transfer area. Thus, the protruding toner causes a stain on the back of the sheet.

The problems similar to those described above may possibly occur in an image forming apparatus using a direct transfer method that directly transfers an image from a latent image carrier, such as a photosensitive element, onto a sheet not via an intermediate transfer body.

In view of the above, there is a need to provide an image forming apparatus that can prevent a stain on the back of a sheet caused by a non-transferred toner caused to adhere to an inter-sheet area on an image carrier.

SUMMARY OF THE INVENTION

It is an object of the present invention to at least partially solve the problems in the conventional technology.

An image forming apparatus includes: an image carrier that is rotatably provided and carries a toner image on a surface thereof; a transfer member arranged so as to face the image carrier; and a non-transferred toner adhesion unit that causes a non-transferred toner not to be transferred onto a sheet to adhere to an inter-sheet area present on the image carrier during a period of continuous image formation in which images are continuously formed on the image carrier. The transfer member is a foam roller. The image forming apparatus further includes a contacting and separating unit that causes the foam roller and the image carrier to come into contact with and be separated from each other. The contacting and separating unit separates the image carrier and the transfer member when the inter-sheet area present on the image carrier passes through a transfer area in which the image carrier and the transfer member face each other in association with rotation of the image carrier.

An image forming apparatus is capable of forming a toner image to an edge of a sheet such that there is no margin at edges of an entire perimeter of the sheet or any of the edges of the sheet. The image forming apparatus includes: an image carrier on which a toner image is formed in accordance with image information; a transfer member arranged so as to face the image carrier; a sheet conveying unit that conveys a sheet such that the sheet passes through a transfer area in which the image carrier and the transfer member face each other; a contacting and separating unit that causes the transfer member to come into contact with and be separated from the image carrier; a cleaning unit that cleans a surface of the transfer member; and a non-transferred toner adhesion unit that causes a non-transferred toner not to be transferred onto a sheet to adhere to an inter-sheet area among inter-sheet areas present on the image carrier during a period of continuous image formation for continuously forming images. The contacting and separating unit separates the transfer member from the image carrier when the inter-sheet area to which the non-transferred toner have been caused to adhere by the non-transferred toner adhesion unit passes through the transfer area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments according to the present invention are described below.

First Embodiment

The embodiment according to the present invention will be specifically described below with reference to the accompanying drawings.

In the first embodiment, an explanation will be made of an image forming apparatus that can suppress deterioration in image quality due to vibration caused by a collision of a sheet with a transfer member and prevent a stain on the back of the sheet caused by a non-transferred toner adhering to an inter-sheet area on an image carrier.

Figure 2:
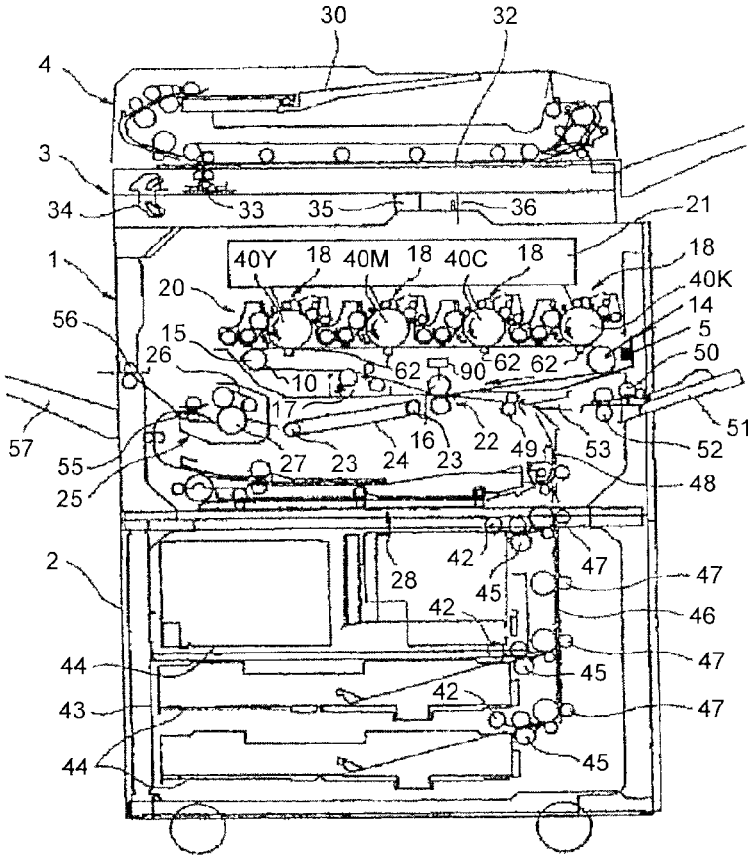
FIG. 2 is a schematic of the whole configuration of an image forming apparatus according to an embodiment of the present invention.

FIG. 2 is a schematic of the whole configuration of the image forming apparatus according to the embodiment and illustrates a color copier (hereinafter, simply referred to as a copier) as an example of the image forming apparatus. The color copier is a tandem electrophotographic apparatus using an intermediate transfer method using an intermediate transfer belt 10 serving as an image carrier. A paper feed table 2 is provided at the lowest part of the copier, a copier main body 1 is provided on top of the paper feed table 2, and a scanner 3 and an automatic document feeder (ADF) 4 are provided on top of the copier main body 1.

The copier main body 1 is provided with a transfer device 20 including the endless intermediate transfer belt 10 roughly in the center thereof. The intermediate transfer belt 10 is stretched around a driving roller 14 and driven rollers 15 and 16 and rotates (makes surface movement) in the clockwise direction in FIG. 2. An intermediate transfer belt cleaning device 17 is provided on the left of the driven roller 15. The intermediate transfer belt cleaning device 17 removes a residual toner remaining on the surface of the intermediate transfer belt 10 after transfer of an image, thereby preparing the intermediate transfer belt 10 for the subsequent image formation.

Four image forming units 18Y, 18M, 18C, and 18K of yellow, magenta, cyan, and black, respectively, are provided above a straight section of the intermediate transfer belt 10 stretched around the driving roller 14 and the driven roller 15 along the direction of surface movement of the intermediate transfer belt 10.

Figure 3:
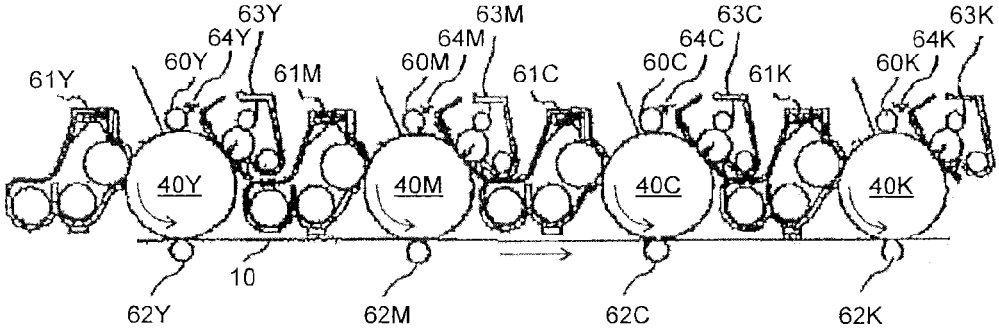
FIG. 3 is an enlarged view of four image forming units and the vicinity thereof.

FIG. 3 is an enlarged view of the four image forming units 18Y, 18M, 18C, and 18K and the vicinity thereof. The image forming units 18Y, 18M, 18C, and 18K are provided with drum-shaped photosensitive elements 40Y, 40M, 40C, and 40K, respectively, serving as image carriers (hereinafter, reference letters for classification by color of Y, M, C, and K are omitted in the case where classification by color is not necessary). The photosensitive elements 40 are each provided so as to be rotatable in the counterclockwise direction in FIG. 3. The photosensitive elements 10 are each provided with a charging device 60, a developing unit 61, a primary transfer device 62 serving as a primary transfer unit, a photosensitive element cleaning device 63, and a neutralization device 64 therearound. As illustrated in FIG. 2, an exposing device 21 is provided above the photosensitive elements 40.

A secondary transfer roller 22 serves as a transfer member constituting a secondary transfer unit and is provided below the intermediate transfer belt 10. The secondary transfer roller 22 is pressed against the drive roller 16 with the intermediate transfer belt 10 interposed therebetween. The secondary transfer roller 22 collectively transfers toner images formed on the intermediate transfer belt 10 onto a sheet P fed into a secondary transfer area in which the secondary transfer roller 22 and the intermediate transfer belt 10 face each other. A secondary transfer bias applying power source 90 serves as a transfer bias applying unit and applies a transfer bias to the driven roller 16. The transfer bias forms a transfer electric field for transferring the toner images formed on the intermediate transfer belt 10 onto the sheet in the secondary transfer area.

Transfer of the toner images from the intermediate transfer belt 10 onto the sheet by application of a bias may be carried out by: applying a bias with the same polarity as a normal charging polarity of the toner to the driven roller 16 from the back side of the intermediate transfer belt 10; or applying a bias with a polarity opposite to that of the toner to the secondary transfer roller 22 from the back side of the sheet with the secondary transfer bias applying power source 90. The method for applying the bias is not limited to either of the methods described above. In the present embodiment, the secondary transfer bias applying power source 90 applies a negative bias with the same polarity as a negative polarity, which is the normal charging polarity of the toner, to the driven roller 16.

In the present embodiment, a foam roller is used as the secondary transfer roller 22, which will be described later in detail. Using a piece of thick paper as the specific sheet P increases a shock of a collision of the thick paper with the secondary transfer roller 22 caused when the thick paper is fed into the secondary transfer area in the state in which the secondary transfer roller 22 is brought into contact with the intermediate transfer belt 10 compared with the case of using a piece of thin paper. The shock causes large vibration on the secondary transfer roller 22, and the vibration is transmitted to the photosensitive element 40 in the image forming unit 18 and the exposing device 21. As a result, a position at which the exposing device 21 writes a latent image on the photosensitive element 40 may possibly deviate from a normal position, resulting in deterioration in image quality.

To address this, a foam roller obtained by covering a cored bar with foam is used as the secondary transfer roller 22. As a result, the foam mitigates a shock of a collision of the thick paper with the foam roller to reduce vibration caused by the collision, thereby making it possible to suppress the deterioration in image quality.

To form an image on the thick paper serving as the specific sheet P, it is preferable that the secondary transfer roller 22 and the intermediate transfer belt 10 be separated from each other by a secondary transfer contacting and separating mechanism 70 (refer to FIGS. 7A and 7B, for example), which will be described later, before the leading end of the thick paper enters the secondary transfer area.

If a firm sheet P, such as a piece of thick paper, enters the secondary transfer area in the state in which the secondary transfer roller 22 is brought into contact with the intermediate transfer belt 10, vibration when the leading end of the sheet collides with the secondary transfer roller 22 and the intermediate transfer belt 10 at the entrance of the secondary transfer area increases. The vibration may possibly be transmitted to the intermediate transfer belt 10, resulting in deterioration in image quality.

To address this, the secondary transfer roller 22 and the intermediate transfer belt 10 are separated from each other when the thick paper enters the secondary transfer area. As a result, the leading end of the thick paper becomes less likely to collide with the secondary transfer roller 22 and the intermediate transfer belt 10 at the entrance of the secondary transfer area. This makes it possible to keep the vibration caused by the collision from being transmitted to the intermediate transfer belt 10 and causing deterioration in image quality.

Even if the secondary transfer roller 22 and the intermediate transfer belt 10 are separated from each other in this manner, the fluctuation of the feed path for the thick paper may possibly cause the leading end of the thick paper to collide with the secondary transfer roller 22. Even if the leading end of the thick paper collides with the secondary transfer roller 22, by a foam roller as the secondary transfer roller 22, the foam mitigates a shock of the collision and vibration caused by the collision is reduced, thereby suppressing the deterioration in image quality.

After the leading end of the thick paper enters the secondary transfer area, the secondary transfer roller 22 is brought into contact with the intermediate transfer belt 10, making it possible to transfer an image formed on the intermediate transfer belt 10 onto the thick paper.

In the present embodiment, the secondary transfer roller 22 is driven to rotate by a driving mechanism different from a driving mechanism for the driving roller 14 that rotates the intermediate transfer belt 10. With this configuration, driving force supplied from a driving source provided to the driving mechanism for the secondary transfer roller 22 assists rotational drive of the intermediate transfer belt 10 when the thick paper serving as the sheet P enters the transfer nip. This can reduce fluctuations in speed of the intermediate transfer belt 10. As a result, it is possible to reduce shock jitter occurring in association with fluctuations in speed of the intermediate transfer belt 10.

A fixing device 25 is provided on the downstream of the secondary transfer roller 22 in a sheet conveying direction. The fixing device 25 fixes a toner image formed on a sheet by heat and pressure at a fixing nip formed by pressing a pressing roller 27 against an endless fixing belt 26. A sheet onto which an image is transferred is conveyed to the fixing nip of the fixing device 25 by an endless conveying belt 24 stretched around a-two stretching rollers 23.

A sheet reversing device 28 is provided below the secondary transfer roller 22 and reverses the front and back of a sheet to form images on both sides of the sheet.

To make a color copy with the color copier according to the present embodiment, a document is set on a document table 30 of the ADF 4. Alternatively, the ADF 4 is opened to set the document on an exposure glass 32 of the scanner 3. If the document is set on the exposure glass 32, closing the ADF 4 causes the document to be pressed against the exposure glass 32. If the document is set on the ADF 4, pressing a start switch, which is not illustrated, causes the document to be automatically fed onto the exposure glass 32.

By contrast, if the document is set on the exposure glass 32, pressing the start switch causes the scanner 3 to promptly operate, whereby a first running body 33 and a second running body 34 start to run. As a result, the document is irradiated with light output from a light source of the first running body 33. Reflected light from the document surface is reflected by a mirror of the first running body 33 in a direction toward the second running body 34. The light is further reflected by 180 degrees by a pair of mirrors of the second running body 34, passes through an imaging lens 35, and is incident on a scanning sensor 36. Thus, the contents of the document are read.

Pressing the start switch described above causes the intermediate transfer belt 10 to start to rotate and causes the photosensitive elements 40 to start to rotate. Thus, monochrome toner images of yellow, magenta, cyan, and black are formed on the respective photosensitive elements 40. The monochrome toner images formed on the respective photosensitive elements 40 in this manner are sequentially transferred onto the intermediate transfer belt 10 rotating in the clockwise direction of FIG. 2 in a superimposed manner. Thus, a full-color synthetic image is formed.

A paper feeding roller 42 of a selected paper feed shelf in the paper feed table 2 rotates to pull out a sheet P from a selected paper cassette 44 in a paper bank 43. The sheet P is separated one by one by a separating roller 45 and conveyed to a feed path 46. The pulled out sheet P is conveyed to a feed path 48 of the copier main body 1 by a conveying roller 47. The sheet P then comes into contact with a pair of registration rollers 49 and is temporarily stopped. in the case of the manual feed, a sheet P set on a manual feed tray 51 is pulled out by rotation of a bypass paper feeding roller 50. The sheet P is separated one by one by a bypass separating roller 52 and conveyed to a bypass feed path 53. The sheet P then comes into contact with the pair of registration rollers 49 and is temporarily stopped.

In both cases, the pair of registration rollers 49 starts to rotate at an accurate timing synchronized with a color image formed on the intermediate transfer belt 10. The pair of registration rollers 49 feeds the stopped sheet P into a space between the intermediate transfer belt 10 and the secondary transfer roller 22. The action of the transfer electric field formed by the transfer bias applied to the secondary transfer roller 22 transfers the color image from the intermediate transfer belt 10 onto the sheet. The sheet P onto which the color image is transferred is conveyed to the fixing device 25 by the conveying belt 24. After the transferred image is fixed by heat and pressure, the sheet P is guided to a discharging unit by a switching claw 55. The sheet P is then discharged by a discharging roller 56 and stacked onto a discharge tray 57.

If a duplex copy mode is selected, the sheet P on which the image is formed is conveyed to the sheet reversing device 28 by the switching claw 55. The sheet P is then reversed and guided to the transfer position again. After an image is formed on the back of the sheet P, the sheet P is discharged on the discharge tray 57 by the discharging roller 56.

To form a black monochrome image on the intermediate transfer belt 10, the driven rollers 15 and 16 except for the driving roller 14 are moved to separate the photosensitive elements 40Y, 40M, and 40C of yellow, magenta, and cyan, respectively, from the intermediate transfer belt 10. Unlike the tandem image forming apparatus illustrated in FIG. 2, what is called a single-drum image forming apparatus including one photosensitive element 40 alone typically forms a black image first so as to increase first copy speed. The single-drum image forming apparatus then forms images of the other colors only when the document is a color document.

While the pair of registration rollers 49 is generally grounded when used, a bias may be applied thereto to remove paper dust of the sheet P. To apply a bias using a conductive rubber roller having a diameter of 18 mm and covered with a 1 mm-thick conductive nitrile butadiene rubber (NBR), for example, a voltage may be applied as follows: the volume resistance of the rubber material is approximately $10^9$ Ω·cm; a voltage of approximately −800 V is applied to the roller facing the side where the toner is transferred (front side) among the pair of registration rollers 49; and a voltage of approximately +200 V is applied to the roller on the back side of the sheet.

Because paper dust is typically unlikely to move to the photosensitive element 40 in the intermediate transfer method, it is less necessary to consider transfer of the paper dust, and the pair of registration rollers 49 may be grounded. While a direct-current (DC) bias is typically applied as the applied voltage, an alternating-current (AC) voltage having a DC offset component may be applied to charge the sheet more uniformly. The surface of the sheet that passes through the pair of registration rollers 49 to which the bias is applied in this manner is slightly negatively charged. As a result, transfer conditions in transfer of an image from the intermediate transfer belt 10 onto the sheet P change compared with the case where no voltage is applied to the registration rollers. Thus, the transfer conditions may possibly be changed.

The copier according to the present embodiment includes a toner adhesion amount sensor 5 serving as an adhesion amount detecting unit that detects a toner adhesion amount (density) on the intermediate transfer belt 10. The toner adhesion amount sensor 5 used herein is provided with an infrared light emitting diode serving as a light-emitting element and a photodiode serving as a diffuse reflection light receiving element. The toner adhesion amount sensor 5 outputs a voltage corresponding to the amount of received light.

Figure 4:
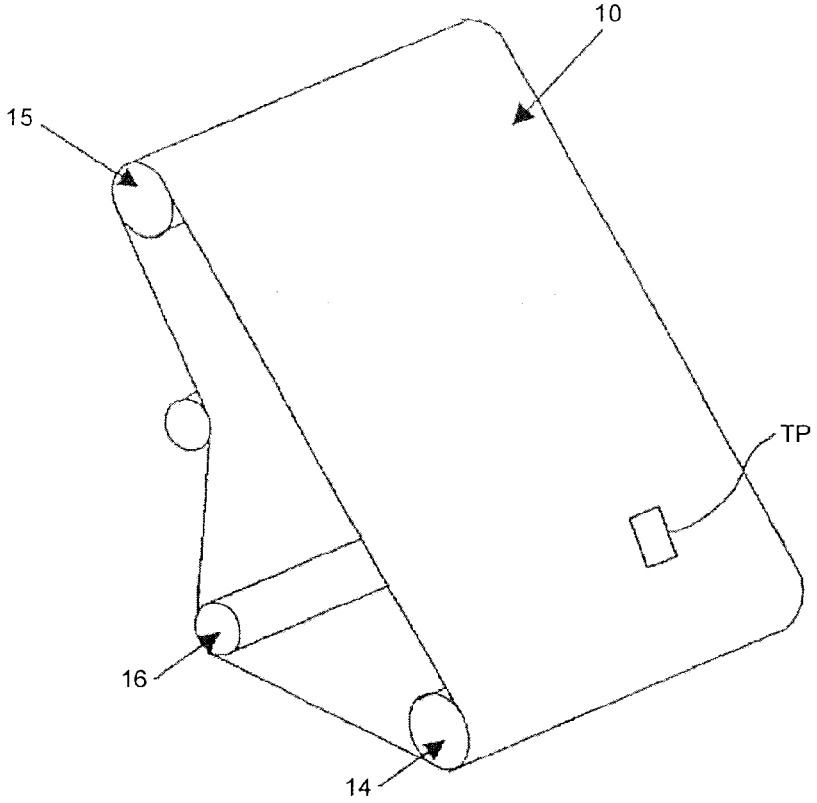
FIG. 4 illustrates a state where a toner pattern for density adjustment control is formed on an intermediate transfer belt.

FIG. 4 illustrates a state where a toner pattern TP for density adjustment control composed of a plurality of types of density detection toner patches is formed on the intermediate transfer belt 10. The toner pattern TP formed on the photosensitive element 40 is transferred onto the intermediate transfer belt 10 by the primary transfer device 62 in a primary transfer area where the photosensitive element 40 and the intermediate transfer belt 10 are brought into contact with each other. Thus, the toner pattern TP adheres to the intermediate transfer belt 10.

In the toner pattern TP for density adjustment control, a plurality of toner patches is typically formed for each color so as to have target densities different from each other. The toner adhesion amount sensor 5 attached so as to face the intermediate transfer belt 10 detects the toner adhesion amount (toner density) of each toner patch. The toner adhesion amount detection with the toner pattern TP is performed at the following two timings: that is, it is performed in a process control mode (a density adjustment control mode) independent of an image forming operation or is performed utilizing an inter-sheet area (an inter-toner image area) on the intermediate transfer belt 10 during a period of continuous image formation (during continuous printing).

The toner pattern TP is formed in an inter-sheet area by the same method as that for a normal toner image. Specifically, the toner image is formed by the photosensitive element 40, the charging device 60, the developing unit 61, and so on illustrated in FIG. 3.

Figure 5:
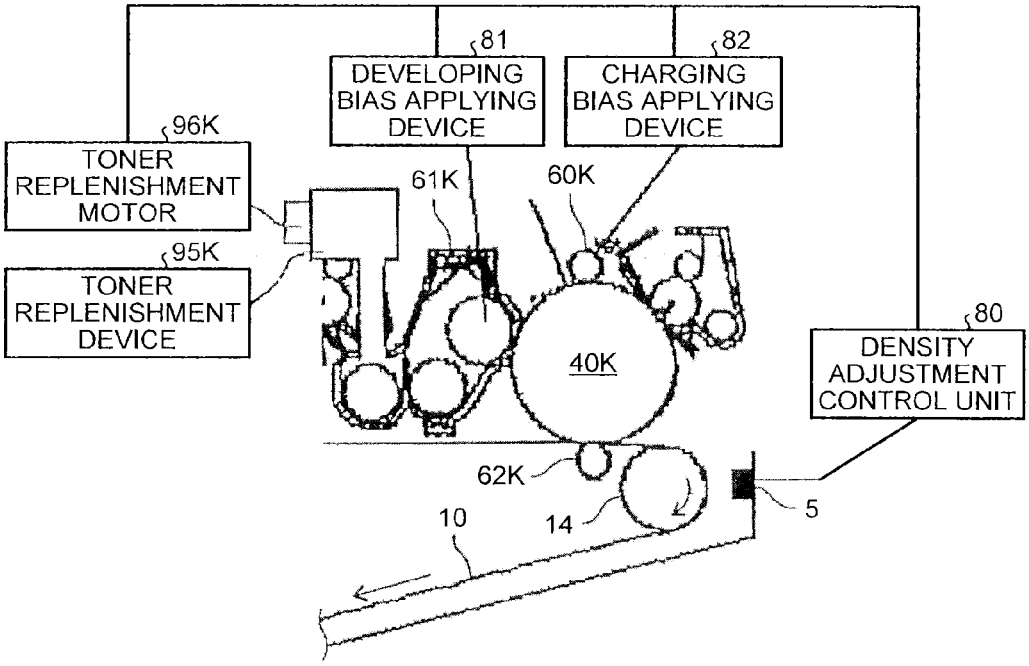
FIG. 5 is a view for explaining toner density control using the toner pattern.

The toner density control using the toner pattern TP will now be described. The toner adhesion amount sensor 5 illustrated in FIG. 5 detects the toner adhesion amount of respective toner patches of the toner pattern TP. Based on the values thus detected, a density adjustment control unit 80 controls at least one of a toner replenishment motor 96, a developing bias applying device 81, and a charging bias applying device 82 to adjust the image density. In the case of performing the adjustment by controlling the toner replenishment motor 96, the toner density is adjusted by controlling toner replenishment performed by a toner replenishment device 95, whereby the image density is adjusted. In the case of adjusting a developing bias or a charging bias by controlling the developing bias applying device 81 and the charging bias applying device 82, the image density is adjusted by controlling the value of the bias. While the explanation has been made of the image forming unit 18K alone in FIG. 5, actual control is performed on all the colors.

A succession of image forming operations of images having low image area ratio increases the amount of old toner remaining in the developing unit 61 for a long time, thereby deteriorating the charging characteristics of the toner. Using the old toner for image formation deteriorates the image quality (deterioration in developing capacity and deterioration in transferability). To address this, the copier according to the present embodiment has a refresh mode for refreshing the toner in the developing unit 61. In the refresh mode, the toner is ejected to an inter-sheet area on the photosensitive element 40 at a certain timing to prevent the old toner from remaining in the developing unit 61. After ejecting the toner, the developing unit 61 is replenished with new toner, thereby refreshing the toner inside the developing unit 61.

A control unit, which is not illustrated, stores therein the toner consumption amount of developing units 61Y, 61M, 61C, and 61K and the operating time or the developing units 61Y, 61M, 61C, and 61K. The control unit determines whether the toner consumption amount when the operating time of each developing unit 61 reaches a predetermined time period is equal to or smaller than a threshold for each developing unit 61 at a predetermined timing. The control unit performs the refresh mode on the developing unit 61 whose toner consumption amount is equal to or smaller than the threshold.

If the refresh mode is performed, a toner consumption pattern is formed on an inter-sheet area on the photosensitive element 40 and transferred onto the intermediate transfer belt 10. The adhesion amount of the toner consumption pattern is determined based on the toner consumption amount when the operating time of the developing unit 61 reaches the predetermined time period. The maximum adhesion amount per unit area may possibly be approximately 1.0 mg/cm$^2$. Measurement of toner Q/d distribution in the toner consumption pattern transferred onto the intermediate transfer belt 10 shows that it almost corresponds to the normal charging polarity.

The toner consumption pattern formed in the inter-sheet area on the photosensitive element 40 in this manner is transferred onto an inter-sheet area on the intermediate transfer belt 10. The toner consumption pattern is then removed from the intermediate transfer belt 10 by the intermediate transfer belt cleaning device 17.

Figure 6A:
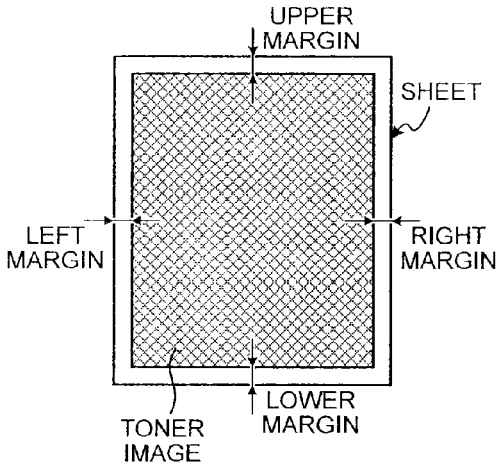
FIG. 6A is a schematic of bordered printing.
Figure 6B:
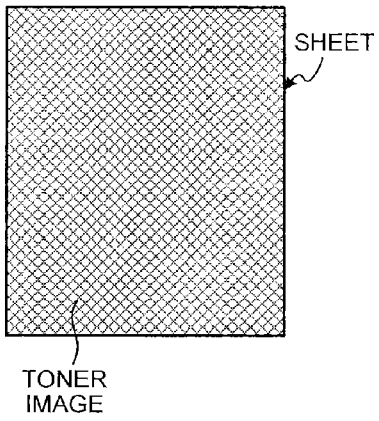
FIG. 6B is a schematic of borderless printing.
Figure 6C:
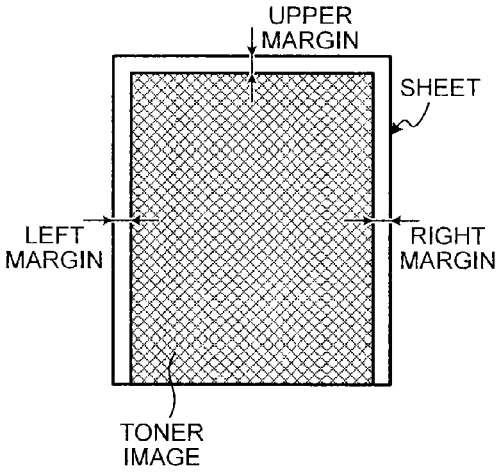
FIG. 6C is schematic of trailing-end borderless printing.

Bordered printing and borderless printing will now be described. FIG. 6A is a schematic of bordered printing, FIG. 6B is a schematic of borderless printing, and FIG. 6C is schematic of trailing-end borderless printing.

The color copier according to the present embodiment has a bordered printing mode for forming a toner image on a sheet such that there is a margin at edges of the entire perimeter of the sheet and a borderless printing mode for forming a toner image on a sheet such that there is no margin at any of the edges of the sheet. An operator, for example, selects one of the bordered printing mode and the borderless printing mode with an operating unit, which is not illustrated, provided to the copier main body 1, whereby bordered printing or borderless printing is carried out.

In bordered printing, the whole toner image formed on the intermediate transfer belt 10 is included inside a sheet. As illustrated in FIG. 6A, there are margins (an upper margin, a lower margin, a left margin, and a right margin) at the entire perimeter (top, bottom, left, and right) of the sheet. By contrast, in borderless printing, a toner image is formed on the intermediate transfer belt 10 so as to protrude from edges of a sheet. As illustrated in FIG. 6B, the toner image is present on the very edges of the sheet, and there is no margin at the edges of the entire perimeter (top, bottom, left, and right) of the sheet. FIG. 6B illustrates the state where there is no margin at the edges of the entire perimeter (all the top, bottom, left, and right portions) of the sheet. In the present embodiment, however, absence of a margin at one or more edges of the top, bottom, left, and right edges of the sheet is considered as borderless printing.

In trailing-end borderless printing, a toner image is formed on the intermediate transfer belt 10 such that the toner image protrudes from a lower edge of a sheet but not from other edges (an upper edge, a left edge, and a right edge) of the sheet. In other words, as illustrated in FIG. 6C, the toner image is present on the very lower edge of the sheet with no margin (no lower margin) at the lower edge of the sheet and with margins (an upper margin, a left margin, and a right margin) at the other edges of the sheet.

The method for controlling an image forming apparatus related to image formation in borderless printing is publicly known. Because the present invention is not intended to limit the method for controlling borderless printing, the explanation of an example of the control method is omitted.

Examples according to the present invention will now be described using the electrophotographic apparatus with the configuration described above.

First Example

A first example uses a foam roller obtained by covering a metal cored bar with a foamed rubber serving as a foam member as the secondary transfer roller 22. While the material of the foamed rubber is not particularly restricted, an NBR rubber is used in this example, and formulation is controlled such that Asker C hardness is 40 degrees.

Figure 7A:
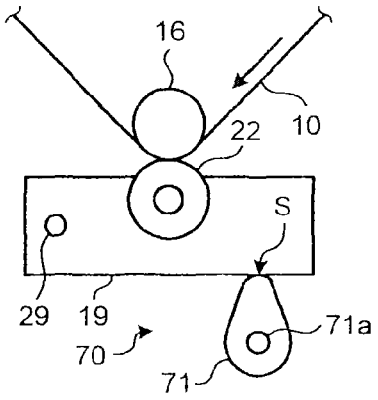
FIG. 7A illustrates a state where the secondary transfer roller is in contact with an intermediate transfer belt.
Figure 7B:
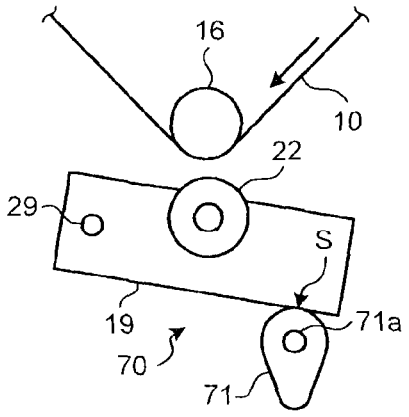
FIG. 7B illustrates a state where the secondary transfer roller is separated from the intermediate transfer belt.

FIGS. 7A and 7B are schematics for explaining a configuration and an operation of the secondary transfer contacting and separating mechanism 70 that separates the secondary transfer roller 22 from the intermediate transfer belt 10. FIG. 7A illustrates a state where the secondary transfer roller 22 is brought into contact with the intermediate transfer belt 10. FIG. 7B illustrates a state where the secondary transfer roller 22 is separated from the intermediate transfer belt 10.

The secondary transfer contacting and separating mechanism 70 according to the present example includes a swinging member 19. The swinging member 19 rotatably supports a secondary transfer roller shaft 22*a* of the secondary transfer roller 22 and is swingable with respect to the apparatus main body about a swinging shaft 29. The secondary transfer contacting and separating mechanism 70 further includes a contacting and separating cam 71 serving as a cam member that is rotatable about a rotating shaft 71*a*. The contacting and separating cam 71 is arranged such that its cam face comes into contact with a cam contact position S provided to the bottom surface of the swinging member 19. The secondary transfer contacting and separating mechanism 70 further includes a driving device (a contacting and separating motor), which is not illustrated, serving as a rotational driving unit that rotates the contacting and separating cam 71.

In the present example, in the state where the contacting and separating cam 71 rotates to a rotational position at which a portion of the cam face farthest from the rotating shaft 71*a* of the contacting and separating cam 71 comes into contact with the cam contact position S of the swinging member 19, the secondary transfer roller 22 is brought into contact with the intermediate transfer belt 10 as illustrated in FIG. 7A. By contrast, in the state where the contacting and separating cam 71 rotates to a rotational position at which a portion of the cam face closest to the rotating shaft 71*a* of the contacting and separating cam 71 comes into contact with the cam contact position S of the swinging member 19, the secondary transfer roller 22 is separated from the intermediate transfer belt 10 as illustrated in FIG. 7B. The rotational position at which the portion of the cam face closest to the rotating shaft 71*a* of the contacting and separating cam 71 comes into contact with the cam contact position S of the swinging member 19 is a position at which the contacting and separating cam 71 rotates 180 degrees with respect to the rotational position illustrated in FIG. 7A.

While the contacting and separating cam 71 is being rotated from the contact state, the swinging member 19 remains in contact with the cam face of the contacting and separating cam 71 under its own weight. Therefore, rotation of the contacting and separating cam 71 from the contact state causes the swinging member 19 to rotate in the clockwise direction in FIG. 7A about the swinging shaft 29. In association with this, the secondary transfer roller 22 is separated from the intermediate transfer belt 10 as illustrated in FIG. 7B.

In the present example, when an inter-sheet area on the intermediate transfer belt 10 passes through the secondary transfer area, the secondary transfer contacting and separating mechanism 70 separates the secondary transfer roller 22 from the intermediate transfer belt 10. Before a subsequent sheet P enters the secondary transfer area, the secondary transfer contacting and separating mechanism 70 brings the secondary transfer roller 22 into contact with the intermediate transfer belt 10.

Figure 1:
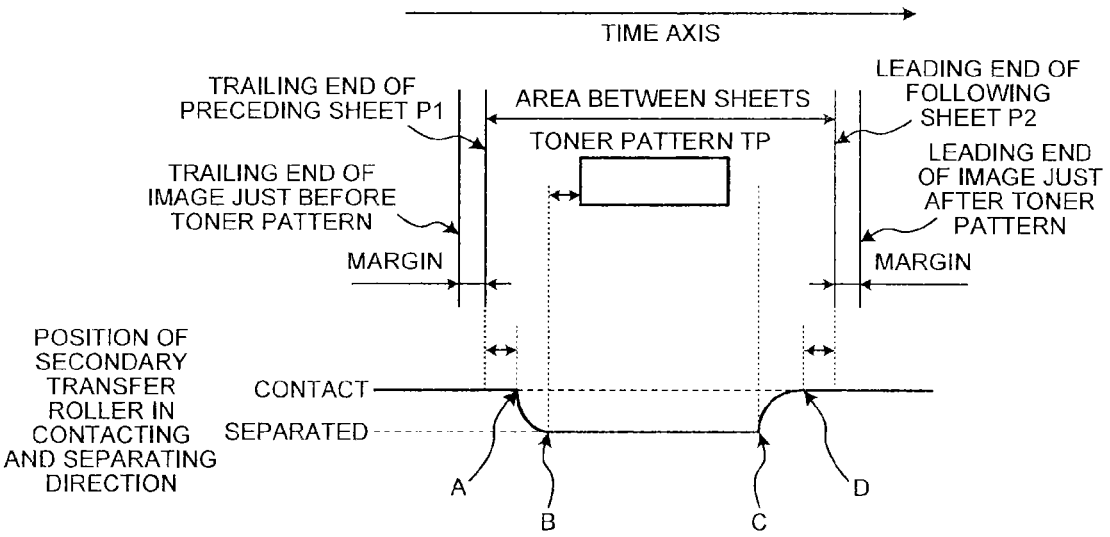
FIG. 1 is a view for explaining contents of control of an operation for contacting and separating a secondary transfer roller in bordered printing in a first example.

FIG. 1 is a view for explaining contents of control of an operation for contacting and separating the secondary transfer roller 22 in bordered printing in the present example. FIG. 1 illustrates timings at which the sheet P, the toner image, and the toner pattern TP pass through the secondary transfer area and timings for contacting and separating the secondary transfer roller 22, with time on the horizontal axis.

In the present example, the toner pattern TP is formed in the inter-sheet area on the intermediate transfer belt 10 at a predetermined timing in continuous printing. The toner adhesion amount sensor 5 then detects the toner pattern TP, thereby performing process control (density adjustment control). When the toner pattern TP formed on the intermediate transfer belt 10 passes through the secondary transfer area, no sheet P is present in the secondary transfer area. If the secondary transfer roller 22 remains in contact with the intermediate transfer belt 10, the toner pattern TP comes into contact with the surface of the secondary transfer roller 22 and adheres thereto. The toner adhering to the surface of the secondary transfer roller 22 is transferred from the secondary transfer roller 22 onto a sheet subsequently fed into the secondary transfer area, thereby causing a stain on the back of the sheet.

To address this, a control unit, which is not illustrated, controls the contacting and separating motor of the contacting and separating cam 71, thereby performing contacting and separating control illustrated in FIG. 1 in the present example. During a toner pattern passing period (a non-transferred toner passing period) in which the toner pattern TP is passing through the secondary transfer area, the secondary transfer roller 22 and the intermediate transfer belt 10 are separated from each other.

Specifically, the secondary transfer roller 22 is first brought into contact with the intermediate transfer belt 10 as illustrated in FIG. 7A. Subsequently, a toner image just before formation of the toner pattern TP is secondarily transferred onto a preceding sheet P1 in the secondary transfer area. After the trailing end of the preceding sheet P1 then passes through the secondary transfer area, the control unit controls the contacting and separating motor of the contacting and separating cam 71, thereby causing the contacting and separating cam 71 to start to rotate (time A in FIG. 1). The timing at which the contacting and separating cam 71 starts to rotate is set as follows: before the leading end of the toner pattern TP enters the secondary transfer area, the contacting and separating cam 71 completes a half turn, thereby separating the secondary transfer roller 22 from the intermediate transfer belt 10 as illustrated in FIG. 7B (time B in FIG. 1).

After the trailing end of the toner pattern TP passes through the secondary transfer area, the control unit controls the contacting and separating motor of the contacting and separating cam 71, thereby causing the contacting and separating cam 71 to start to rotate (time C in FIG. 1). The timing at which the contacting and separating cam 71 starts to rotate is set as follows: before the leading end of a following sheet P2 enters the secondary transfer area, the contacting and separating cam 71 completes a half turn, thereby bringing the secondary transfer roller 22 into contact with the intermediate transfer belt 10 as illustrated in FIG. 7A (time D in FIG. 1).

Figure 8:
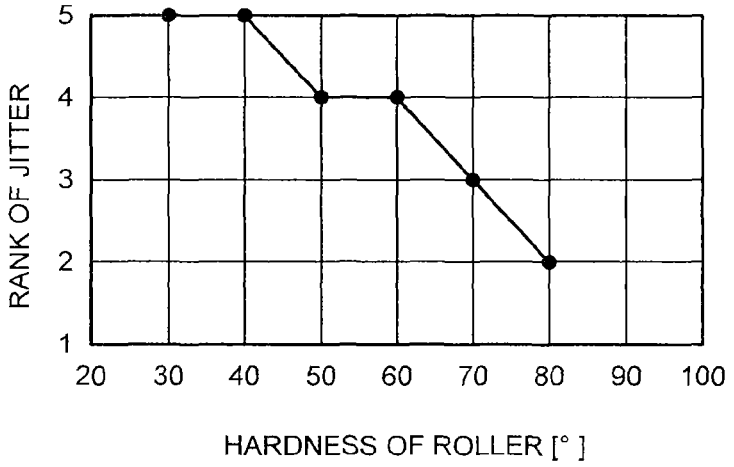
FIG. 8 is a graph of the result obtained by evaluating shock jitter.

FIG. 8 illustrates the result obtained by evaluating shock jitter in this configuration. The shock jitter was evaluated by five-grade visual rank evaluation. Rank 5 is the best grade with no jitter, whereas rank 1 is the worst. Grades of equal to or higher than rank 4 are acceptable. An evaluated sheet was a piece of thick paper with a basis weight of 300 g/m$^2$. To evaluate also influences affecting primary transfer, development, and writing when the sheet enters, the largest jitter was evaluated among jitter occurring when ten evaluated sheets were continuously passed.

Besides the foam roller having Asker C hardness of 40 degrees of the present example, foam rollers having Asker C hardness of 70 degrees, 60 degrees, 50 degrees, and 30 degrees, and a solid rubber roller having Asker C hardness of 80 degrees were used as the secondary transfer roller 22 to perform the evaluation for comparison.

FIG. 8 shows that lower hardness of the secondary transfer roller 22 makes jitter less likely to occur and that Asker C hardness of equal to or lower than 60 degrees causes jitter to fall within the allowable range. Furthermore, Asker C hardness of equal to or lower than 40 degrees reduces jitter to a level at which jitter is not visually detected. As the hardness of the roller is reduced, however, the roller is more likely to deform by being subjected to pressure repeatedly. Thus, it is not preferable to reduce the hardness of the roller more than necessary.

Second Example

A second example is provided with a second transfer contacting and separating mechanism that moves the secondary transfer roller 22 more reliably. FIGS. 9A, 9B, and 9C and FIGS. 10A, 10B, and 10C are schematics of the secondary transfer contacting and separating mechanism.

The secondary transfer contacting and separating mechanism 70 according to the present example performs two or more separating operations for separating the secondary transfer roller 22 and the intermediate transfer belt 10 from each other with different clearances between the secondary transfer roller 22 and the intermediate transfer belt 10. In other words, the secondary transfer contacting and separating mechanism 70 separates the secondary transfer roller 22 and the intermediate transfer belt 10 from each other also in a normal separation period, which is a period of separation other than in the inter-sheet area in continuous printing.

Figure 9A:
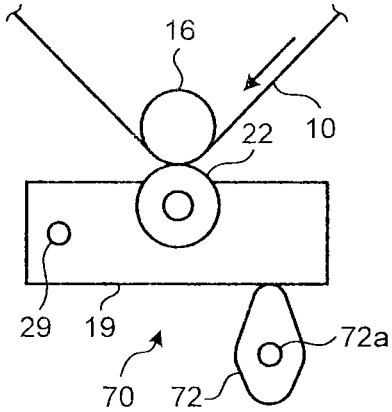
FIG. 9A illustrates a state where the secondary transfer roller is in contact with the intermediate transfer belt.
Figure 9B:
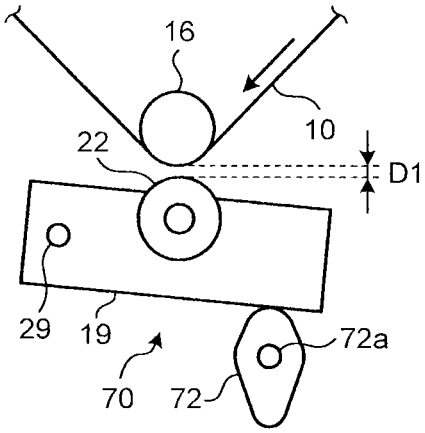
FIG. 9B illustrates a state where the secondary transfer roller is separated from the intermediate transfer belt in an inter-sheet area in continuous printing.
Figure 9C:
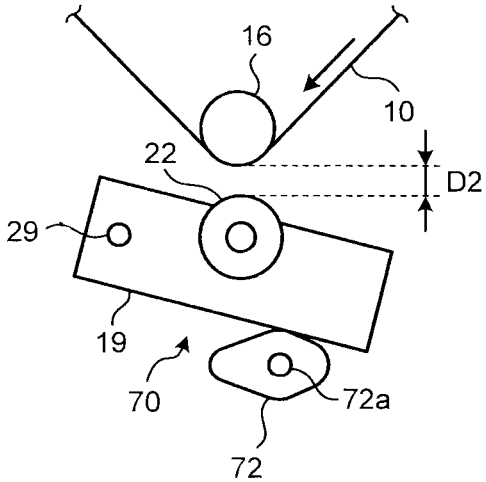
FIG. 9C illustrates a state where the secondary transfer roller is separated from the intermediate transfer belt in a normal separation period.

The secondary transfer contacting and separating mechanism 70 illustrated in FIGS. 9A, 9B, and 9C includes a swinging member 19. The swinging member 19 rotatably supports a secondary transfer roller shaft 22*a* of the secondary transfer roller 22 and is swingable with respect to the apparatus main body about a swinging shaft 29. The secondary transfer contacting and separating mechanism 70 further includes a contacting and separating cam 72 serving as a cam member that is rotatable about a rotating shaft 72*a*. The contacting and separating cam 72 is arranged such that its cam face comes into contact with a cam contact position S provided to the bottom surface of the swinging member 19. The secondary transfer contacting and separating mechanism 70 further includes a driving device (a contacting and separating motor), which is not illustrated, serving as a rotational driving unit that rotates the contacting and separating cam 72.

The secondary transfer contacting and separating mechanism 70 illustrated in FIGS. 9A, 9B, and 9C is a configuration example in which the shape of the contacting and separating cam 72 enables the secondary transfer roller 22 to move with respect to the intermediate transfer belt 10 in three steps. FIG. 9A illustrates a state where the secondary transfer roller 22 is brought into contact with the intermediate transfer belt 10. FIG. 9B illustrates a state where the secondary transfer roller 22 is separated from the intermediate transfer belt 10 in an inter-sheet area in continuous printing. FIG. 9C illustrates a state where the secondary transfer roller 22 is separated from the intermediate transfer belt 10 in the normal separation period and is separated further away from the intermediate transfer belt 10 than the state illustrated in FIG. 9B.

In a contacting operation for shifting the state of the secondary transfer roller 22 and the intermediate transfer belt 10 from the respective separated states achieved by the two or more separating operations to a contact state, the secondary transfer contacting and separating mechanism 70 shifts the state from the respective separated states to the contact state by a single operation. Furthermore, in the separating operations for shifting the state of the secondary transfer roller 22 and the intermediate transfer belt 10 from the contact state to the respective separated states, the secondary transfer contacting and separating mechanism 70 shifts the state to the respective separated states by a single operation.

In other words, rotation of the contacting and separating cam 72 by the contacting and separating motor, which is not illustrated, enables the secondary transfer roller 22 in any of the states of FIG. 9A to FIG. 9C to move to different positions illustrated in FIG. 9A, FIG. 9B, and FIG. 9C.

In the present example, the contacting and separating cam 72 has a shape as follows: rotating the contacting and separating cam 72 180 degrees from the state of FIG. 9A can bring the contacting and separating cam 72 into the state of FIG. 9B; and rotating the contacting and separating cam 72 90 degrees from the state of FIG. 9A or FIG. 9B can bring the contacting and separating cam 72 into the state of FIG. 9C. The shape of the contacting and separating cam 72 is not limited thereto.

Figure 10A:
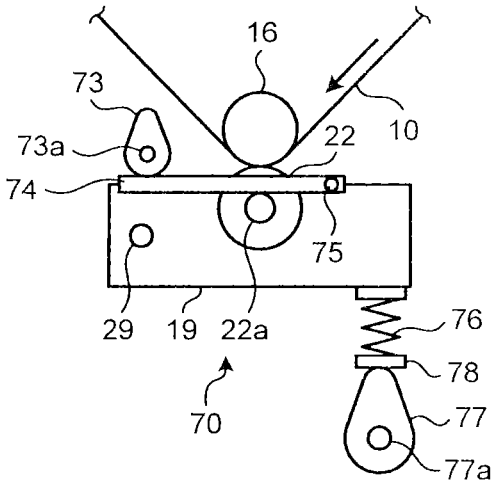
FIG. 10A illustrates a state where the secondary transfer roller is in contact with the intermediate transfer belt.
Figure 10B:
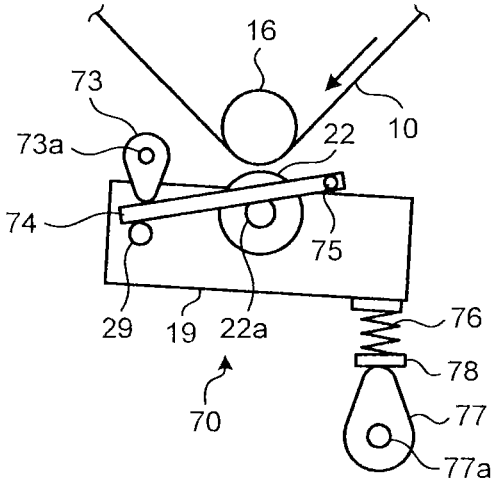
FIG. 10B illustrates a state where the secondary transfer roller is separated from the intermediate transfer belt in an inter-sheet area in continuous printing.
Figure 10C:
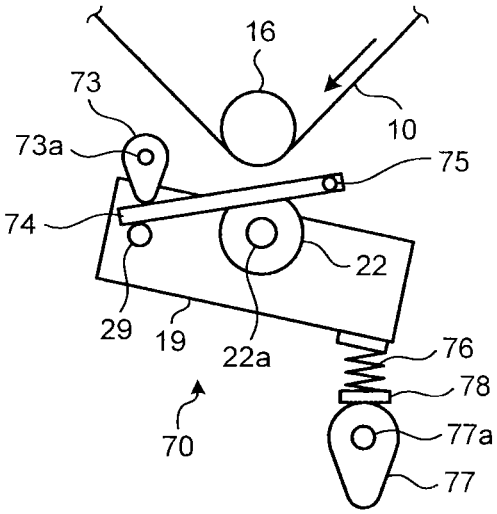
FIG. 10C illustrates a state where the secondary transfer roller is separated from the intermediate transfer belt in the normal separation period.

FIGS. 10A, 10B, and 10C illustrate a configuration example in which the use of two cams of a contacting and separating cam 73 (with a rotating shaft 73*a*) and a contacting and separating cam 77 enables the secondary transfer roller 22 to move with respect to the intermediate transfer belt 10 in three steps. FIG. 10A illustrates a state where the secondary transfer roller 22 is brought into contact with the intermediate transfer belt 10. FIG. 10B illustrates a state where the secondary transfer roller 22 is separated from the intermediate transfer belt 10 in an inter-sheet area in continuous printing. FIG. 10C illustrates a state where the secondary transfer roller 22 is separated from the intermediate transfer belt 10 in the normal separation period and is separated further away from the intermediate transfer belt 10 than the state illustrated in FIG. 10B.

The secondary transfer contacting and separating mechanism 70 illustrated in FIGS. 10A, 10B, and 10C includes a swinging member 19. The swinging member 19 rotatably supports a secondary transfer roller shaft 22*a* of the secondary transfer roller 22 and is swingable with respect to the apparatus main body about a swinging shaft 29. The upper end of a spring 76 is attached to the bottom surface of the swinging member 19 at the right in FIG. 10A to FIG. 10C. The secondary transfer contacting and separating mechanism 70 further includes a contacting and separating cam 77 serving as a cam member that is rotatable about a rotating shaft 77*a*. The contacting and separating cam 77 is arranged such that its cam face comes into contact with a contact plate 78 provided to the lower end of the spring 76. The contacting and separating cam 77 is driven to rotate by a contacting and separating motor serving as a rotational driving unit, which is not illustrated.

The secondary transfer contacting and separating mechanism 70 further includes a swinging arm 74 that is swingable with respect to the apparatus main body about a swinging fulcrum 75. The bottom surface of the swinging arm 74 nearly in the center in FIG. 10A to FIG. 10C is brought into contact with and separated from the secondary transfer roller shaft 22*a*. The bottom surface of the swinging arm 74 on the left in FIG. 10A to FIG. 10C is brought into contact with and separated from the swinging shaft 29. The swinging arm 74 can be swung by driving to rotate the contacting and separating cam 73 using a contacting and separating motor serving as a rotational driving unit, which is not illustrated. The contacting and separating cam 73 serves as a cam member and is arranged such that its cam face comes into contact with a cam contact position provided to the top surface of the swinging arm 74 at the left in FIG. 10A to FIG. 10C.

Rotation of the contacting and separating cam 73 by the contacting and separating motor, which is not illustrated, in the state of FIG. 10A causes the swinging arm 74 to swing downward about the swinging fulcrum 75. As a result, the bottom surface of the swinging arm 74 presses down the secondary transfer roller shaft 22*a*. Pressing down the secondary transfer roller shaft 22*a* causes the swinging member 19 to swing downward about the swinging shaft 29 and thus to be pressed down. This causes the secondary transfer roller 22 to be separated from the intermediate transfer belt 10 as illustrated in FIG. 10B. On this occasion, the spring 76 is biased against the swinging member 19 and compressed compared with the state of FIG. 10A. At this time, the swinging member 19 is biased upward by the compressed spring 76. The secondary transfer roller shaft 22*a* supported by the swinging member 19 comes into contact with the bottom surface of the swinging arm 74, thereby positioning the swinging member 19 in the vertical direction at the height illustrated in FIG. 10B.

Rotation of the contacting and separating cam 77 180 degrees by the contacting and separating motor, which is not illustrated, in the state of FIG. 10B causes the lower end of the compressed spring 76 to descend. As a result, the amount of compression of the compressed spring 76 is reduced, thereby reducing the biasing force that biases the swinging member 19 upward. This causes the upper end of the compressed spring 76 to descend under the weight of the swinging member 19 and/or the like. Thus, as illustrated in FIG. 10C, the secondary transfer roller 22 moves in a direction further away from the intermediate transfer belt 10 than the position illustrated in FIG. 10B. At this time, the swinging member 19 is positioned at a height at which the weight of the swinging member 19 and/or the like balances the biasing force of the compressed spring 76. As a result, the secondary transfer roller 22 is separated further away from the intermediate transfer belt 10 than the separated state illustrated in FIG. 10B.

Figure 11:
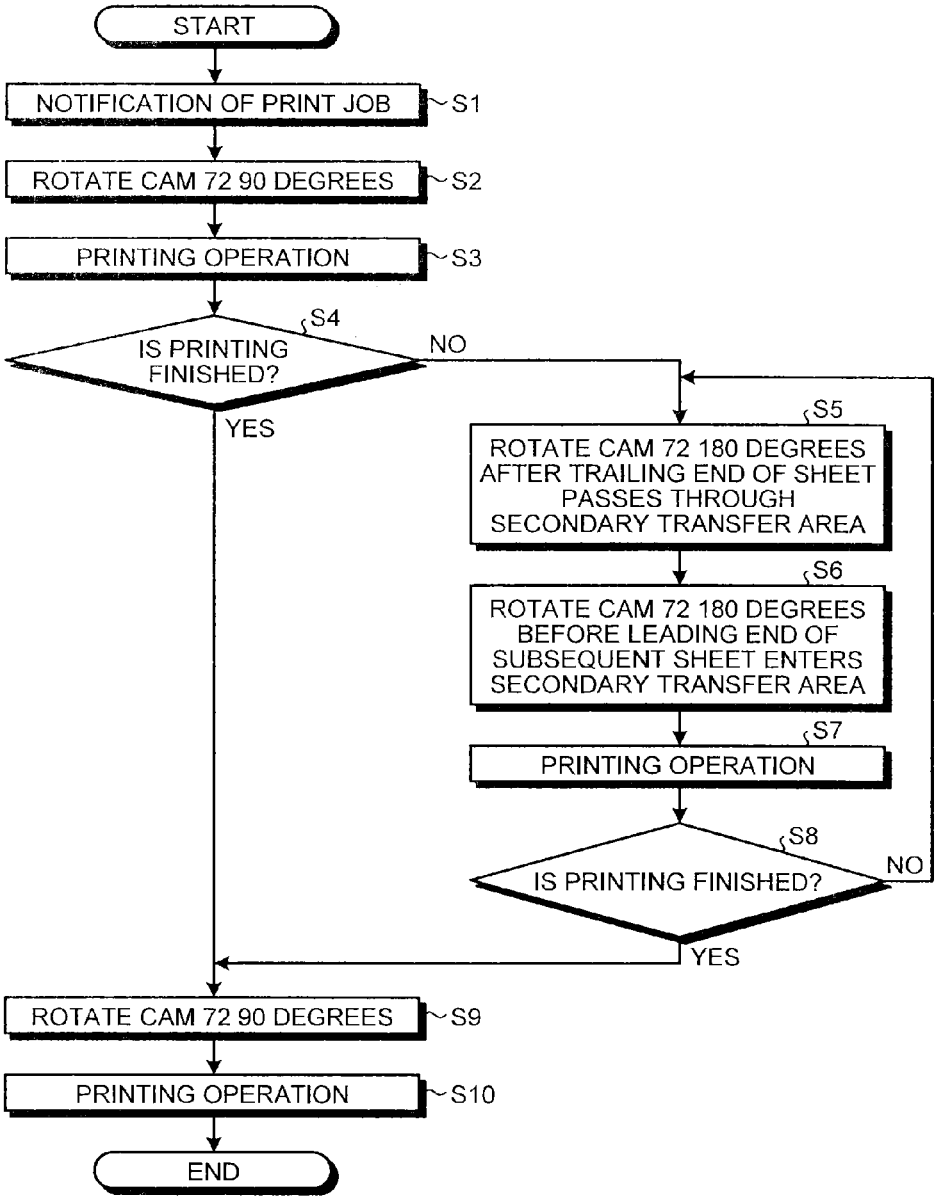
FIG. 11 is a flowchart of secondary transfer contacting and separating control in the inter-sheet area.

FIG. 11 is a flowchart of secondary transfer contacting and separating control in the inter-sheet area. While the flowchart illustrates an example in which the secondary transfer contacting and separating mechanism 70 in FIGS. 9A to 9C is used, it is not limited thereto. It basically also applies to any structure enabling the secondary transfer roller 22 to move with respect to the intermediate transfer belt 10 in three steps, such as the secondary transfer contacting and separating mechanism 70 illustrated in FIGS. 10A to 10C and other contacting and separating structures.

After notification of a print job (Step S1), the contacting and separating cam 72 is rotated 90 degrees to be shifted from the state of FIG. 9C to the state of FIG. 9A before the sheet P enters the secondary transfer area (Step S2). After a printing operation is carried out (Step S3), if there is no image to be subsequently printed and the printing is to be finished (Yes at Step S4), the contacting and separating cam 72 is rotated 90 degrees to be shifted from the state of FIG. 9A to the state of FIG. 9C (Step S9). Subsequently, the printing is finished, and the series of control is terminated.

By contrast, if there is a subsequent image (No at Step S4), the contacting and separating cam 72 is rotated 180 degrees to be shifted from the state of FIG. 9A to the state of FIG. 9B after the trailing end of the sheet passes through the secondary transfer area (Step S5).

Subsequently, the contacting and separating cam 72 is rotated 180 degrees to be shifted from the state of FIG. 9B to the state of FIG. 9A before the leading end of a subsequent sheet enters the secondary transfer area (Step S6). After a printing operation is carried out (Step S7), if there is no subsequent image and the printing is to be finished (Yes at Step S8), the contacting and separating cam 72 is rotated 90 degrees to be shifted from the state of FIG. 9A to the state of FIG. 9C (Step S9). Subsequently, the printing is finished (Step S10), and the series of control is terminated.

By contrast, if there is a subsequent image (No at Step S8), the contacting and separating cam 72 is rotated 180 degrees to be shifted from the state of FIG. 9A to the state of FIG. 9B after the trailing end of the sheet passes through the secondary transfer area (Step S5). The control similar to that described above is repeatedly performed until there is no subsequent image and the printing is to be finished.

Third Example

A third example switches the secondary transfer bias applied by the secondary transfer bias applying power source 90 to a bias with a polarity opposite to that in normal printing (a bias with a positive polarity) while the secondary transfer roller 22 is separated from the intermediate transfer belt 10. In the present embodiment, the bias is applied to the driven roller 16 by the secondary transfer bias applying power source 90.

At this time, the toner pattern TP for density adjustment control is formed in an inter-sheet area on the intermediate transfer belt 10. Therefore, the bias with the reverse polarity described above prevents the toner pattern TP from adhering to the secondary transfer roller 22.

Figure 12:
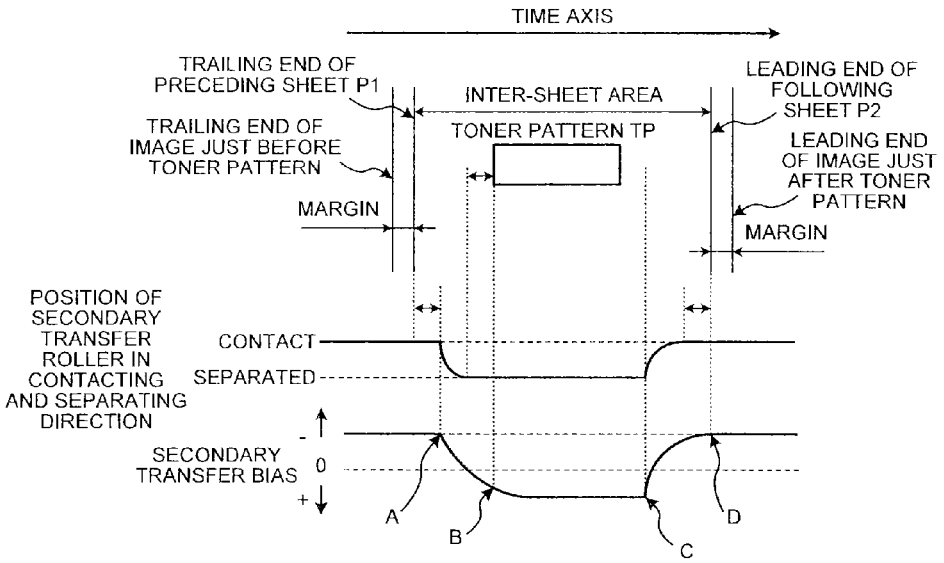
FIG. 12 is a view for explaining contents of control of a secondary transfer contacting and separating operation and switching control of a secondary transfer bias according to a third example.

FIG. 12 is a view for explaining contents of secondary transfer contacting and separating control and switching control of the secondary transfer bias in the inter-sheet area according to the present example. FIG. 12 illustrates timings at which the sheet P, the toner image, and the toner pattern TP pass through the secondary transfer area, timings for contacting and separating the secondary transfer roller 22, and switching timings at which the secondary transfer bias applying power source 90 switches the secondary transfer bias, with time on the horizontal axis.

In the present example, the secondary transfer bias is switched as follows. First, After the trailing end of the preceding sheet P1 passes through the secondary transfer area formed between the secondary transfer roller 22 and the intermediate transfer belt 10, the secondary transfer bias is switched from negative to positive (time A in FIG. 12). Then, the secondary transfer bias is caused to already become positive when the toner pattern TP enters the secondary transfer area (time B in FIG. 12). Subsequently, after the toner pattern TP passes through the secondary transfer area, the secondary transfer bias is switched from positive to negative (time C in FIG. 12). Then, the secondary transfer bias is caused to already become the bias in normal output before the leading end of the following sheet P2 enters the secondary transfer area (time D in FIG. 12).

Figure 13:
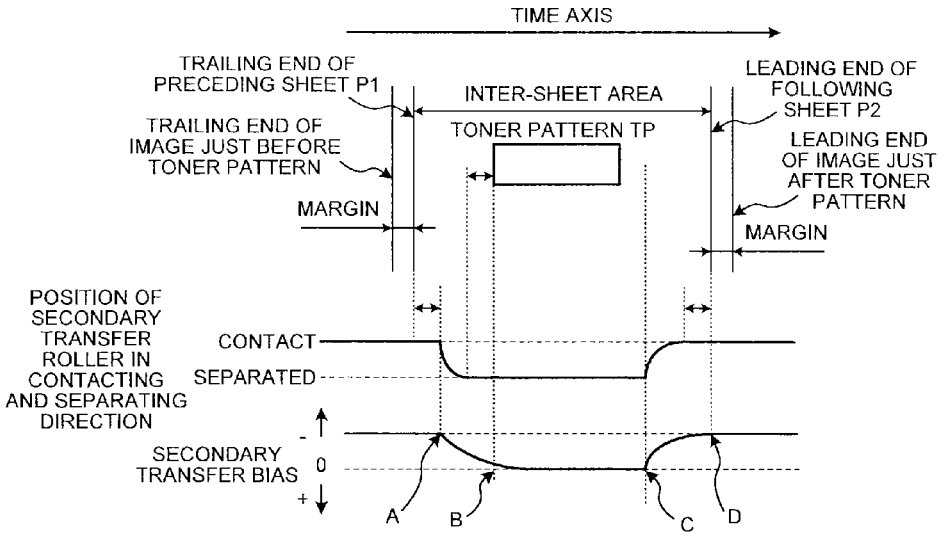
FIG. 13 is a view for explaining contents of control of the secondary transfer contacting and separating operation and switching control of the secondary transfer bias according to a comparative example.

The following describes a comparative example in which output of the secondary transfer bias is turned OFF instead of switching the secondary transfer bias to the bias with the reverse polarity (bias with the positive polarity) when the secondary transfer roller 22 is separated from the intermediate transfer belt 10. FIG. 13 is a view for explaining contents of control of the contacting and separating operation according to the comparative example. FIG. 13 illustrates timings at which the sheet P, the toner image, and the toner pattern TP pass through the secondary transfer area and timings for contacting and separating the secondary transfer roller 22, with time on the horizontal axis.

In the comparative example, the secondary transfer bias is switched as follows. First, after the trailing end of the preceding sheet P1 passes through the secondary transfer area, the secondary transfer bias is turned OFF (time A in FIG. 13). As a result, when the toner pattern TP enters the secondary transfer area, the secondary transfer bias may possibly fail to drop to 0 (time B in FIG. 13). Subsequently, after the toner pattern TP passes through the secondary transfer area, the secondary transfer bias is turned ON (time C in FIG. 13). Then, switching of the secondary transfer bias is caused to already end before the leading end of the following sheet P2 enters the secondary transfer area (time D in FIG. 13).

Although depending on the performance of the power source, it is likely to take longer for the secondary transfer bias to drop to 0 in the switching of the secondary transfer bias as in the comparative example than the case of switching the secondary transfer bias to the bias with the reverse polarity as in the present example. As a result, when the toner pattern TP enters the secondary transfer area, the secondary transfer bias may possibly fail to drop to 0 as illustrated at the time B in FIG. 13. In this case, electric potential difference between the intermediate transfer belt 10 and the secondary transfer roller 22 may possibly apply force to the toner in a direction toward the secondary transfer roller 22, thereby causing the toner to fly to and stain the secondary transfer roller 22.

By contrast, the secondary transfer bias is switched to the bias with the polarity opposite to the normal polarity while the secondary transfer roller 22 is separated from the intermediate transfer belt 10 in the inter-sheet area in the present example. As a result, the force caused by the electric field and applied to the toner pattern TP on the intermediate transfer belt 10 acts in a direction opposite to the secondary transfer roller 22. This makes the toner less likely to fly from the intermediate transfer belt 10 to the secondary transfer roller 22, thereby preventing a toner stain on the secondary transfer roller 22. Although depending on the performance of the power source, it takes some time for the secondary transfer bias to shift to the bias with the reverse polarity. Compared with the case where the secondary transfer bias is turned OFF as in the comparative example, however, reduction of the electric potential difference between the secondary transfer roller 22 and the intermediate transfer belt 10 to 0 can be accelerated as illustrated at the time B in FIG. 12.

To keep the transfer electric field constant even if the resistance of the sheet, the secondary transfer roller 22, or the like changes, constant current control is typically performed on the secondary transfer bias. In switching of the secondary transfer bias to the bias with the reverse polarity when the secondary transfer roller 22 is separated from the intermediate transfer belt 10, however, the separated state between the secondary transfer roller 22 and the intermediate transfer belt 10 makes it difficult for the electric current to flow or prevents the electric current from flowing. If constant current control is performed on the secondary transfer bias with the reverse polarity applied while the secondary transfer roller 22 and the intermediate transfer belt 10 are separated from each other, the voltage is made extremely high so as to achieve a predetermined electric current flow. This may possibly cause a leakage of the electric current at other points, thereby deteriorating the image or damaging the apparatus.

By contrast, the present example performs constant voltage control on the secondary transfer bias with the reverse polarity applied while the secondary transfer roller 22 and the intermediate transfer belt 10 are separated from each other. This makes it possible to prevent the troubles associated with an abnormal rise in the voltage described above and to keep the toner from flying from the intermediate transfer belt 10 to the secondary transfer roller 22.

Fourth Example

If a borderless printing mode, which is a special mode, is selected, a fourth example switches the secondary transfer bias to a bias with the polarity opposite to that in the normal printing and applies the switched secondary transfer bias in an inter-sheet area on the intermediate transfer belt 10 without separating the secondary transfer roller 22 from the intermediate transfer belt 10 in the inter-sheet area. This configuration retransfers the toner adhering to the secondary transfer roller 22 onto the intermediate transfer belt 10 in the inter-sheet area. Furthermore, the present example forms no toner pattern in the inter-sheet area in continuous printing.

A stain on the back of the sheet caused by adhesion of the toner to the surface of the secondary transfer roller 22 is not necessarily attributed to the toner pattern TP and the like formed in the inter-sheet area on the intermediate transfer belt 10.

In the borderless printing mode for carrying out printing to the very edge of the sheet P, the conveyance position of the sheet fluctuates to some extent. Making the size of an image same as that of the sheet may possibly generate a portion with no image formed because of deviation of the image with respect to the sheet P depending on the accuracy of conveyance of the sheet. As a result, the borderless printing fails to be carried out. To address this, an image is typically formed on the intermediate transfer belt 10 so as to protrude from an edge of the sheet P, and the size of the image is made larger than that of the sheet.

If the image is formed so as to protrude from the edge of the sheet P, however, the toner protruding from the edge of the sheet P adheres to the intermediate transfer belt 10. When the image is transferred from the intermediate transfer belt 10 onto the sheet P in the secondary transfer area, the protruding toner adheres from the intermediate transfer belt 10 to the surface of the secondary transfer roller 22. As a result, the toner adhering to the surface of the secondary transfer roller 22 adheres to the back of a sheet P subsequently fed into the secondary transfer area. Thus, the protruding toner causes a stain on the back of the sheet.

Figure 14:
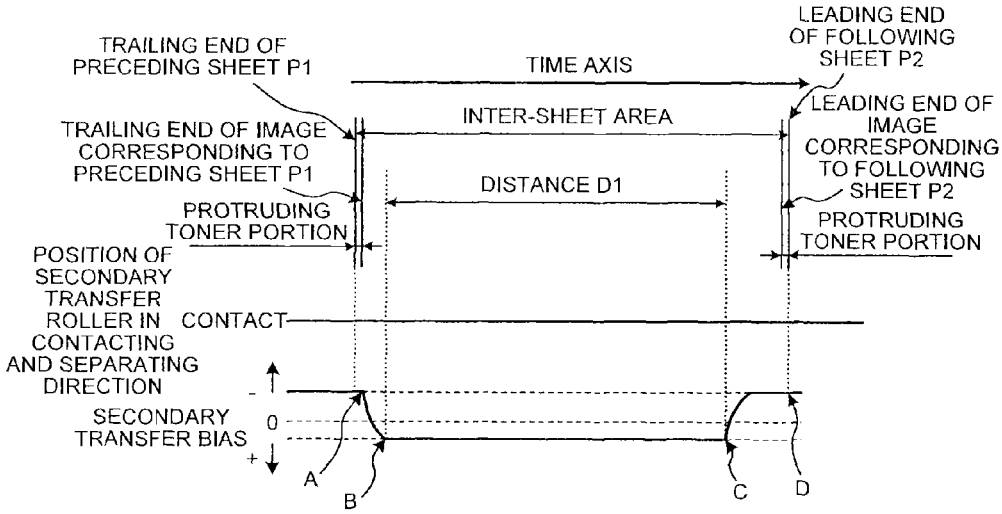
FIG. 14 is a view for explaining contents of control of the secondary transfer contacting and separating operation and switching control of the secondary transfer bias according to a fourth example.

FIG. 14 is a view for explaining contents of secondary transfer contacting and separating control and switching control of the secondary transfer bias in the inter-sheet area according to the present example. FIG. 14 illustrates switching timings at which the secondary transfer bias applying power source 90 switches the secondary transfer bias in the inter-sheet area on the intermediate transfer belt 10 according to the present example, with time on the horizontal axis. In the normal printing, the secondary transfer bias applying power source 90 applies a negative bias with the same polarity as the negative polarity, which is the normal charging polarity of the toner, to the driven roller 16.

In the present example, the secondary transfer bias is switched as follows. First, after the trailing end of the preceding sheet P1 passes through the secondary transfer area, the secondary transfer bias is switched from negative to positive (time A in FIG. 14). A time period T1 for applying the positive bias (a time period between time B and time C in FIG. 14) is set such that a distance D1, which is represented by Distance D1=Rotating Speed of Secondary Transfer Roller 22×Time Period T1, is at least larger than the circumference of the secondary transfer roller 22.

Such a bias-switching operation retransfers a negatively charged toner adhering to the surface of the secondary transfer roller 22 onto the intermediate transfer belt 10, thereby removing the toner on the surface of the secondary transfer roller 22. Making the distance D1 larger than the circumference of the secondary transfer roller 22 makes it possible to remove the negatively charged toner on the entire circumference of the secondary transfer roller 22.

Subsequently, after the time period T1 has elapsed, the secondary bias is switched from positive to negative, thereby causing switching of the secondary transfer bias to end, and the toner removing operation for the secondary transfer roller 22 to be completed before the leading end of the following sheet P2 enters the secondary transfer area (time D in FIG. 14).

In the borderless printing mode, the toner is caused to readhere from the surface of the secondary transfer roller 22 to the intermediate transfer belt 10 in the inter-sheet area, whereby the toner adhering to the surface of the secondary transfer roller 22 is removed. This makes it possible to prevent a stain on the back of the sheet.

Fifth Example

If the borderless printing mode, which is a special mode, is selected, a fifth example does not separate the secondary transfer roller 22 from the intermediate transfer belt 10 in the inter-sheet area on the intermediate transfer belt 10. In addition, the fifth example switches the secondary transfer bias to a bias with the same polarity as that in the normal printing and to a bias with the polarity opposite thereto alternately in the inter-sheet area. This configuration retransfers the toner adhering to the secondary transfer roller 22 onto the intermediate transfer belt 10 in the inter-sheet area. Furthermore, the present example forms no toner pattern in the inter-sheet area in continuous printing.

Figure 15:
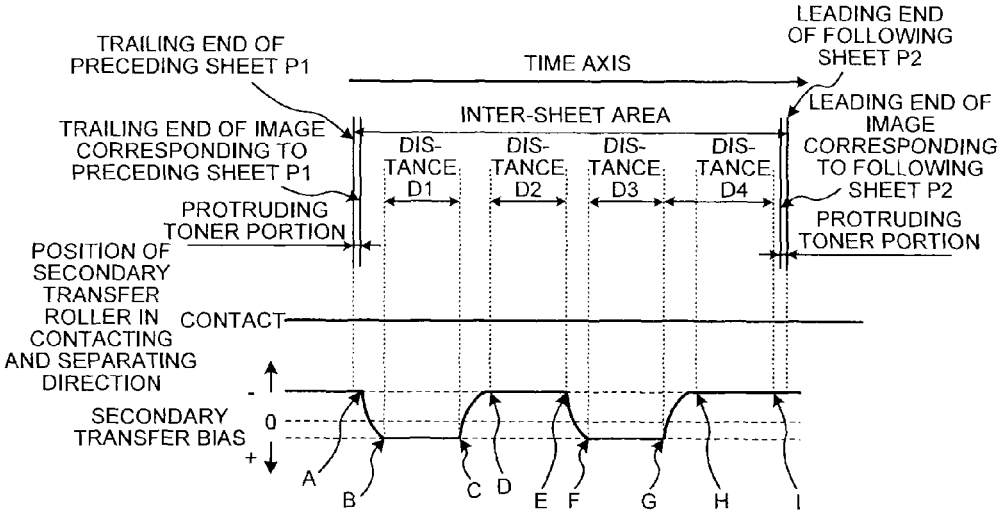
FIG. 15 is a view for explaining contents of control of the secondary transfer contacting and separating operation and switching control of the secondary transfer bias according to a fifth example.

FIG. 15 is a view for explaining contents of secondary transfer contacting and separating control and switching control of the secondary transfer bias in the inter-sheet area according to the present example. FIG. 15 illustrates switching timings at which the secondary transfer bias applying power source 90 switches the secondary transfer bias in the inter-sheet area on the intermediate transfer belt 10 according to the present example, with time on the horizontal axis. In the normal printing, the secondary transfer bias applying power source 90 applies a negative bias with the same polarity as the negative polarity, which is the normal charging polarity of the toner, to the driven roller 16.

In the present example, the secondary transfer bias is switched as follows. First, after the trailing end of the preceding sheet P1 passes through a contact portion of the secondary transfer roller 22 and the intermediate transfer belt 10, the secondary transfer bias is switched from negative to positive (time A in FIG. 15). A time period T1 for applying the positive bias (a time period between time B and time C in FIG. 15) is set such that a distance D1, which is represented by "Distance D1=Rotating Speed of Secondary Transfer Roller 22×Time Period T1", is at least larger than the circumference of the secondary transfer roller 22.

Subsequently, the secondary transfer bias is switched from positive to negative (time C in FIG. 15). A time period T2 for applying the negative bias (a time period between time D and time E in FIG. 15) is set such that a distance D2, which is represented by "Distance D2=Rotating Speed of Secondary Transfer Roller 22×Time Period T2", is at least larger than the circumference of the secondary transfer roller 22.

Subsequently, the secondary transfer bias is switched from negative to positive again (time E in FIG. 15). The time period T1 for applying the positive bias (time period between time F and time G in FIG. 15) is set such that the distance D1, which is represented by "Distance D1=Rotating Speed of Secondary Transfer Roller 22×Time Period T1", is at least larger than the circumference of the secondary transfer roller 22.

Subsequently, the secondary transfer bias is switched from positive to negative again (time G in FIG. 15). The time period T2 for applying the negative bias (time period between time H and time I in FIG. 15) is set such that the distance D2, which is represented by "Distance D2=Rotating Speed of Secondary Transfer Roller 22×Time Period T2", is at least larger than the circumference of the secondary transfer roller 22.

Switching of the secondary transfer bias from the positive bias to the negative bias is caused to end, and the toner removing operation for the secondary transfer roller 22 is caused to end completed before the leading end of the following sheet P2 enters the secondary transfer area (time I in FIG. 15). If the secondary transfer bias at the time D in FIG. 15 is different from the bias in the normal output, the secondary transfer bias is caused to be switched to the bias in the normal output before the leading end of the subsequent sheet enters the secondary transfer area.

The bias-switching operation carried out at the time A and the time E in FIG. 15 retransfers a negatively charged toner adhering to the surface of the secondary transfer roller 22 onto the intermediate transfer belt 10, thereby removing the toner on the surface of the secondary transfer roller. Making the distance D1 larger than the circumference of the secondary transfer roller 22 makes it possible to remove the negatively charged toner on the entire circumference of the secondary transfer roller 22.

Furthermore, the bias-switching operation carried out at the time C and the time G in FIG. 15 retransfers a positively charged toner adhering to the surface of the secondary transfer roller 22 onto the intermediate transfer belt 10, thereby removing the toner on the surface of the secondary transfer roller. While the charging polarity of the toner is typically negative, an electric discharge phenomenon occurring in the transfer process may possibly change the charging polarity to positive. For this reason, the removal of the positively charged toner is carried out. Making the distance D2 larger than the circumference of the secondary transfer roller 22 makes it possible to remove the positively charged toner on the entire circumference of the secondary transfer roller 22.

In the borderless printing mode, the toner is caused to readhere from the surface of the secondary transfer roller 22 to the intermediate transfer belt 10 in the inter-sheet area, whereby the toner adhering to the surface of the secondary transfer roller 22 is removed. This makes it possible to prevent a stain on the back of the sheet.

While the distance of the inter-sheet area is set equal to or larger than four times the circumference of the secondary transfer roller 22 in the present example, the distance is preferably set at least equal to or larger than twice the circumference of the secondary transfer roller 22. This is because the retransfer needs to be performed with both the positive bias and the negative bias each for a time corresponding to one rotation of the secondary transfer roller. An actual configuration requires a distance obtained by adding a time for switching the bias to this distance.

Sixth Example

To carry out trailing-end borderless printing, a sixth example increases the distance of the inter-sheet area compared with the normal printing by a distance corresponding to one or more rotations of the secondary transfer roller. The sixth example, for example, increases the distance of the inter-sheet area compared with the normal printing by a distance corresponding to 1.2 rotations of the secondary transfer roller.

Because an image is formed so as to protrude from the edge at the trailing-end of the sheet P in the trailing-end borderless printing, the toner protruding from the edge at the trailing-end of the sheet P adheres to the intermediate transfer belt 10. When the image is transferred from the intermediate transfer belt 10 onto the sheet P in the secondary transfer area, the protruding toner adheres from the intermediate transfer belt 10 to the surface of the secondary transfer roller 22. As a result, the toner adhering to the surface of the secondary transfer roller 22 adheres to the back of a sheet P subsequently fed into the secondary transfer area. Thus, the protruding toner causes a stain on the back of the sheet.

To address this, the present example switches the secondary transfer bias to a bias with the same polarity as that in the normal printing and to a bias with the polarity opposite thereto in the inter-sheet area in the trailing-end borderless printing. Thus, the present example causes the toner adhering to the secondary transfer roller 22 to readhere to the intermediate transfer belt 10 in the inter-sheet area.

Figure 16:
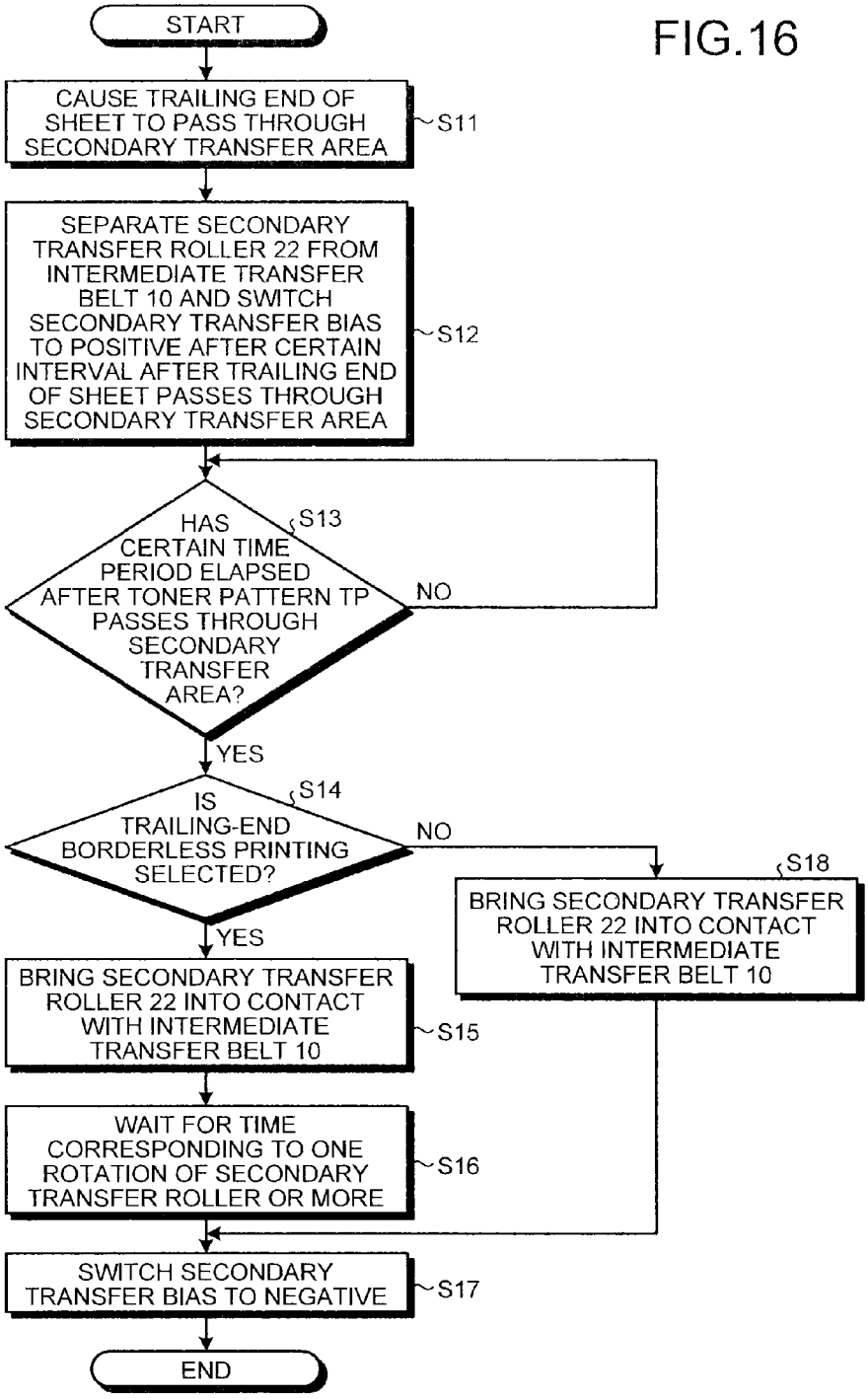
FIG. 16 is a flowchart of the secondary transfer contacting and separating control and the switching control of the secondary transfer bias according to a sixth example.

FIG. 16 is a flowchart of the secondary transfer contacting and separating control and the switching control of the secondary transfer bias in the inter-sheet area in the case of carrying out trailing-end borderless printing and in the case of carrying out no trailing-end borderless printing. The present example can perform an image forming mode for carrying out bordered printing and an image forming mode for carrying out trailing-end borderless printing.

Figure 17:
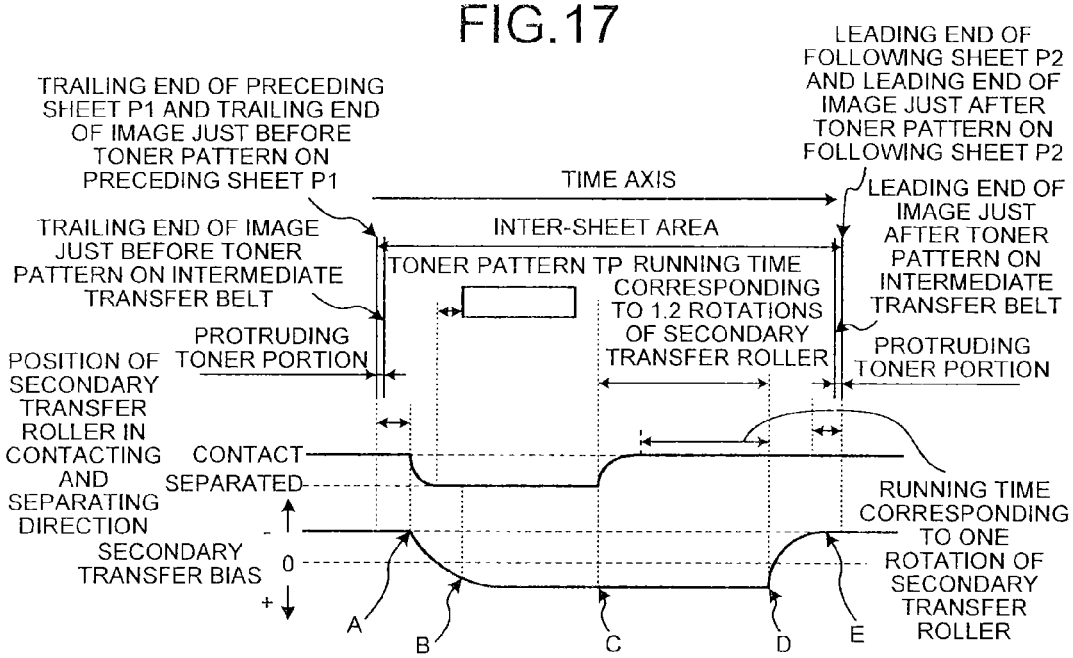
FIG. 17 is a view for explaining contents of control of the secondary transfer contacting and separating operation and switching control of the secondary transfer bias in the case where trailing-end borderless printing is set in the sixth example.

FIG. 17 is a view for explaining contents of control of the secondary transfer contacting and separating operation and the switching control of the secondary transfer bias in the case where trailing-end borderless printing is set in the present example. FIG. 17 illustrates timings at which the sheet P, the toner image, and the toner pattern TP pass through the secondary transfer area, timings for contacting and separating the secondary transfer roller 22, and switching timings at which the secondary transfer bias applying power source 90 switches the secondary transfer bias, with time on the horizontal axis.

If trailing-end borderless printing is not set in the present example, contents of control of the secondary transfer contacting and separating operation and the switching control of the secondary transfer bias are the same as those illustrated in FIG. 12 in the third example.

In the control flow of the present example illustrated in FIG. 16, after the trailing end of the preceding sheet P1 passes through the secondary transfer area (Step S11), the secondary transfer roller 22 is separated from the intermediate transfer belt 10 after a certain interval after the trailing end of the sheet passes through the secondary transfer area regardless of whether trailing-end borderless printing is selected. At the time of the separation of the secondary transfer roller 22, the secondary transfer bias applied by the secondary transfer bias applying power source 90 is switched to the bias with the polarity opposite to that in the normal printing (bias with the positive polarity) (Step S12) (time A in FIG. 12 and time A in FIG. 17). The secondary transfer bias is caused to already become positive when the toner pattern TP enters the secondary transfer area (time B in FIG. 12 and time B in FIG. 17).

The secondary transfer roller 22 is separated from the intermediate transfer belt 10 after the certain interval because of a possibility of the following problem. If the separating operation in the secondary transfer area is carried out just after the trailing end of the sheet passes through the secondary transfer area, the separating operation may possibly be carried out while the sheet still remains in the secondary transfer area depending on fluctuations in the sheet conveyance timing. As a result, the image may possibly be deteriorated.

Subsequently, it is determined whether a certain time period has elapsed after the trailing end of the toner pattern TP passes through the secondary transfer area (S3). If it is determined that the certain time period has elapsed (Yes at Step S13), it is determined whether trailing-end borderless printing is selected (Step S14).

Selection of trailing-end borderless printing is performed by the operator pressing a button for switching between the image forming mode for carrying out bordered printing and the image forming mode for carrying out trailing-end borderless printing in the operating unit provided to the copier main body 1, for example.

If it is determined that trailing-end borderless printing is selected (Yes at Step S14), a contacting operation of the secondary transfer roller 22 to the intermediate transfer belt 10 is started (Step S15) (time C in FIG. 17). After a running time corresponding to 1.2 rotations of the secondary transfer roller has elapsed since the start of the contacting operation (Step S16), the secondary transfer bias applied by the secondary transfer bias applying power source 90 is switched to the bias applied in the normal printing (bias with the negative polarity) (Step S17) (time D in FIG. 17). The secondary transfer bias is caused to already become the bias of normal output before the leading end of the following sheet P2 enters the secondary transfer area (time E in FIG. 17).

By contrast, if it is determined that trailing-end borderless printing is not selected (No at Step S14), the contacting operation of the secondary transfer roller 22 to the intermediate transfer belt 10 is started (Step S18). Along with this, the secondary transfer bias applied by the secondary transfer bias applying power source 90 is switched to the bias applied in the normal printing (bias with the negative polarity) (time C in FIG. 12). The secondary transfer bias is caused to already become the bias of normal output before the leading end of the following sheet P2 enters the secondary transfer area time D in FIG. 12).

When the trailing-end borderless printing is carried out, the distance of the inter-sheet area is increased compared with the normal printing, and switching of the secondary transfer bias after the toner patch TP passes through the secondary transfer area is delayed for a time corresponding to 1.2 rotations of the secondary transfer roller compared with the normal printing. As a result, the state in which the secondary transfer roller 22 is in contact with the intermediate transfer belt 10 and the secondary transfer bias is positive continues for a time corresponding to one rotation of the secondary transfer roller or more as illustrated in FIG. 17. This enables removal of the toner adhering to the surface of the secondary transfer roller by retransferring the toner onto the intermediate transfer belt 10 over the entire circumference of the secondary transfer roller.

In the trailing-end borderless printing, how much the inter-sheet area is to be increased compared with the normal printing, in which trailing-end borderless printing is not performed, to enable cleaning the entire circumference of the secondary transfer roller depends on the switching time of the secondary transfer roller 22. The inter-sheet area needs to be increased by at least a distance corresponding to one rotation of the secondary transfer roller or more compared with the normal printing.

Seventh Example

When trailing-end borderless printing is carried out, a seventh example increases the distance of the inter-sheet area compared with the normal printing by a distance corresponding to two rotations of the secondary transfer roller or more. The sixth example, for example, increases the distance of the inter-sheet area compared with the normal printing by a distance corresponding to three rotations of the secondary transfer roller. Furthermore, to carry out the trailing-end borderless printing, the seventh example switches the secondary transfer bias to a bias with the same polarity as that in the normal printing and to a bias with the polarity opposite thereto alternately in the inter-sheet area. Thus, the seventh example causes the toner adhering to the secondary transfer roller 22 to readhere to the intermediate transfer belt 10 in the inter-sheet area.

Figure 18:
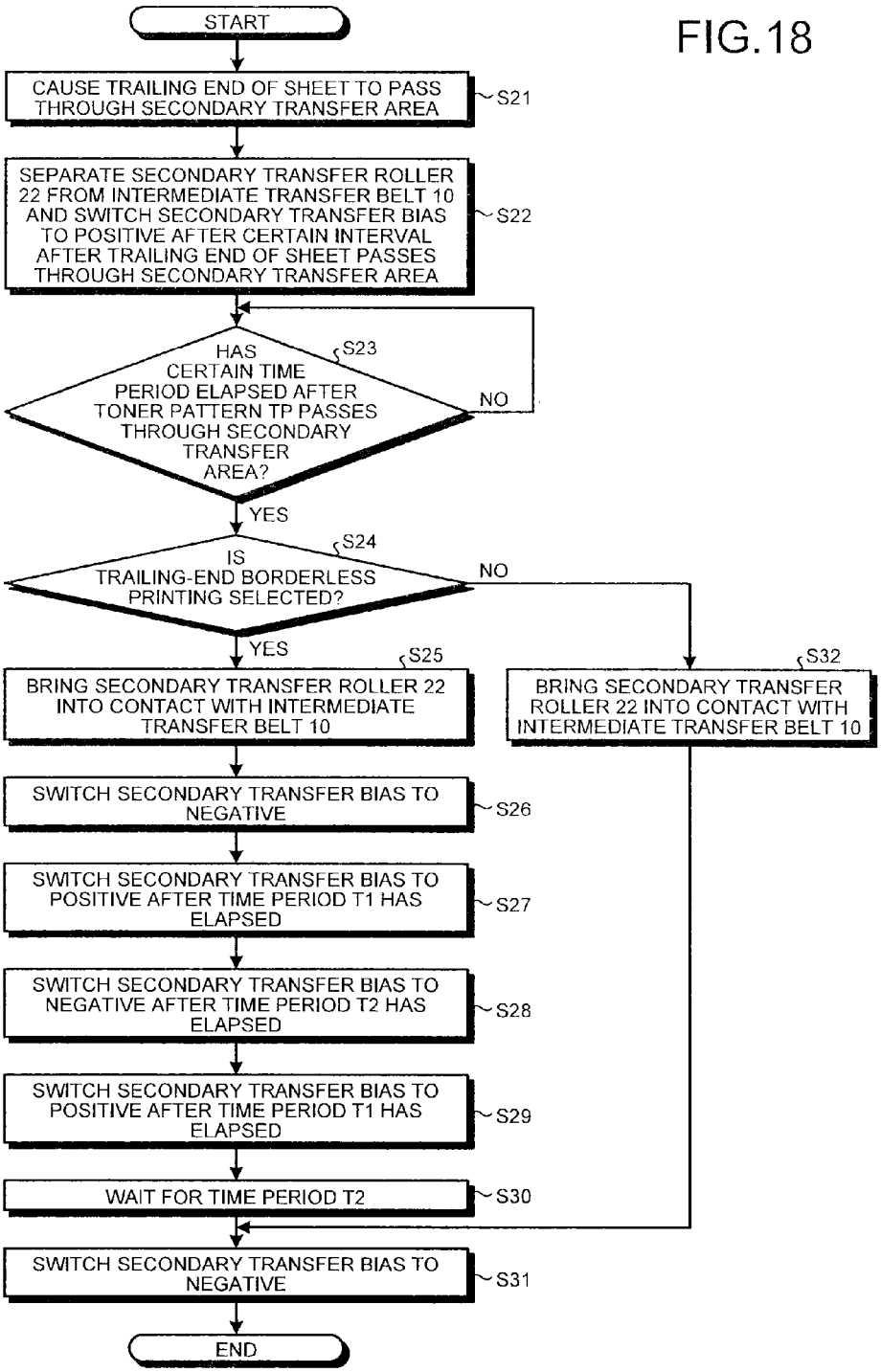
FIG. 18 is a flowchart of the secondary transfer contacting and separating control and the switching control of the secondary transfer bias according to a seventh example.

FIG. 18 is a flowchart of the secondary transfer contacting and separating control and the switching control of the secondary transfer bias in the inter-sheet area in the case of carrying out trailing-end borderless printing and the case of carrying out no trailing-end borderless printing. In the present example, the image forming mode for carrying out bordered printing and the image forming mode for carrying out trailing-end borderless printing are executable.

Figure 19:
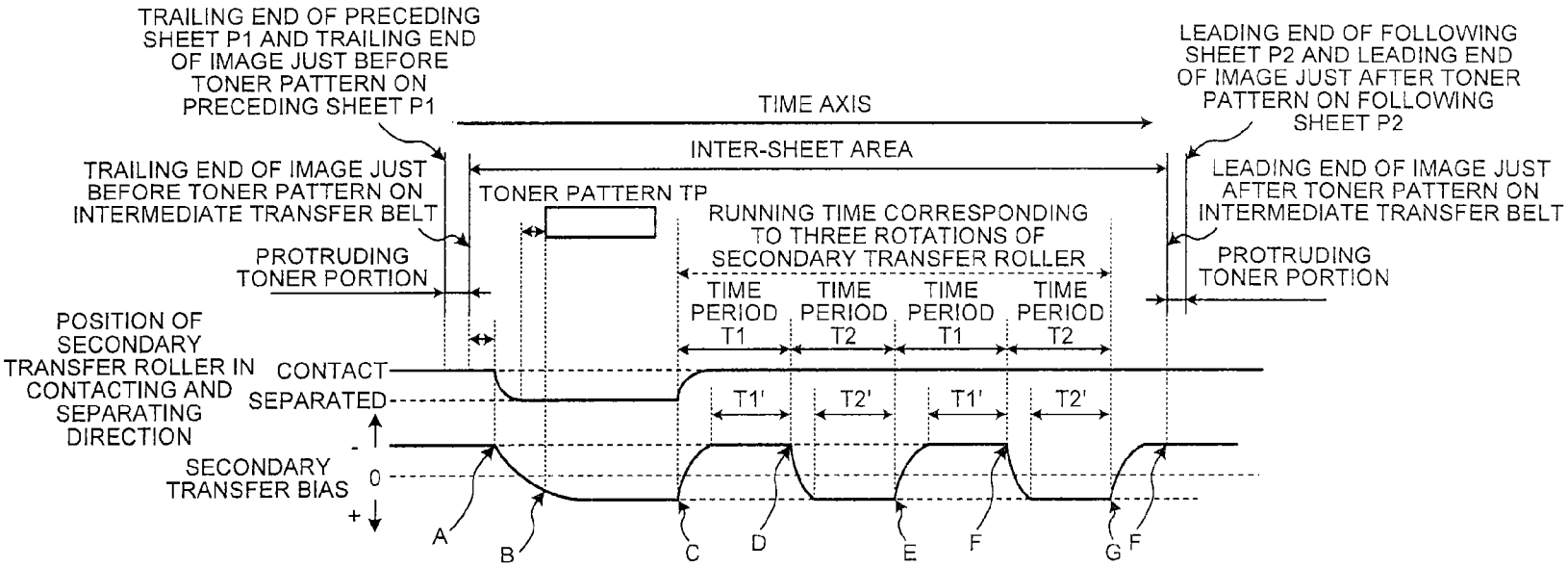
FIG. 19 is a view for explaining contents of control of the secondary transfer contacting and separating operation and switching control of the secondary transfer bias in the case where trailing-end borderless printing is set in the seventh example.

FIG. 19 is a view for explaining contents of control of the secondary transfer contacting and separating operation and the switching control of the secondary transfer bias in the case where trailing-end borderless printing is set in the present example. FIG. 19 illustrates timings at which the sheet P, the toner image, and the toner pattern TP pass through the secondary transfer area, timings for contacting and separating the secondary transfer roller 22, and switching timings at which the secondary transfer bias applying power source 90 switches the secondary transfer bias, with time on the horizontal axis.

If trailing-end borderless printing is not set in the present example, contents of control of the secondary transfer contacting and separating operation and the switching control of the secondary transfer bias are the same as those illustrated in FIG. 12 in the third example.

In the control of the present example, after the trailing end of the preceding sheet P1 passes through the secondary transfer area (Step S21), the secondary transfer roller 22 is separated from the intermediate transfer belt 10 after a certain interval after the trailing end of the sheet passes through the secondary transfer area regardless of whether trailing-end borderless printing is selected. At the time of the separation of the secondary transfer roller 22, the secondary transfer bias applied by the secondary transfer bias applying power source 90 is switched to the bias with the polarity opposite to that in the normal printing (bias with the positive polarity) (Step S22) (time A in FIG. 12 and time A in FIG. 19). The secondary transfer bias is caused to already become positive when the toner pattern TP enters the secondary transfer area (time B in FIG. 12 and time B in FIG. 19).

Subsequently, it is determined whether a certain time period has elapsed after the trailing end of the toner pattern TP passes through the secondary transfer area (Step S23). If it is determined that the certain time period has elapsed (Yes at Step S23), it is determined whether trailing-end borderless printing is selected (Step S24).

If it is determined that trailing-end borderless printing is selected (Yes at Step S24), a contacting operation of the secondary transfer roller 22 to the intermediate transfer belt 10 is started (Step S25). Along with the contacting operation, the secondary transfer bias applied by the secondary transfer bias applying power source 90 is switched to the bias applied in the normal printing (bias with the negative polarity) (Step S26) (time C in FIG. 19).

After a time period T1 has elapsed since the switching of the bias, the secondary transfer bias applied by the secondary transfer bias applying power source 90 is switched to the bias with the polarity opposite to that in the normal printing (bias with the positive polarity) (Step S27) (time D in FIG. 19). After a time period T2 has elapsed since the switching of the bias, the secondary transfer bias applied by the secondary transfer bias applying power source 90 is switched to the bias applied in the normal printing (bias with the negative polarity) (Step S28) (time E in FIG. 19). After the time period T1 has elapsed since the switching of the bias, the secondary transfer bias applied by the secondary transfer bias applying power source 90 is switched to the bias with the polarity opposite to that in the normal printing (bias with the positive polarity) (Step S29) (time F in FIG. 19).

After the time period T2 has elapsed since the switching of the bias (Step S30), the secondary transfer bias applied by the secondary transfer bias applying power source 90 is switched to the bias applied in the normal printing (bias with the negative polarity) (Step S31) (time G in FIG. 19).

Then, the secondary transfer bias is caused to already become the bias of normal output before the leading end of the following sheet P2 enters the secondary transfer area (time H in FIG. 19).

By contrast, if it is determined that trailing-end borderless printing is not selected (No at Step S24), the contacting operation of the secondary transfer roller 22 to the intermediate transfer belt 10 is started (Step S32). Along with this, the secondary transfer bias applied by the secondary transfer bias applying power source 90 is switched to the bias applied in the normal printing (bias with the negative polarity) (Step S11) (time C in FIG. 12). The secondary transfer bias is caused to already become the bias of normal output before the leading end of the following sheet P2 enters the secondary transfer area (time D in FIG. 12).

As illustrated in FIG. 19, the total time period for which the state in which the secondary transfer roller 22 is in contact with the intermediate transfer belt 10 and the secondary transfer bias is negative continues is 2×T1' in total. Furthermore, the total time period for which the state in which the secondary transfer roller 22 is in contact with the intermediate transfer belt 10 and the secondary transfer bias is positive continues is 2×T2' in total.

When the trailing-end borderless printing is carried out, the distance of the inter-sheet area is increased compared with the normal printing, and switching of the secondary transfer bias after the toner patch TP passes through the secondary transfer area is delayed for a time corresponding to three rotations of the secondary transfer roller compared with the normal printing. As a result, it is possible to satisfy Equation 1 and Equation 2:

$$\text{Rotating Speed of Secondary Transfer Roller} \times 2T1' \geq \text{Distance of Entire Circumference of Secondary Transfer Roller(Distance Corresponding to One Rotation)} \quad (1)$$

$$\text{Rotating Speed of Secondary Transfer Roller} \times 2T2' \geq \text{Distance of Entire Circumference of Secondary Transfer Roller(Distance Corresponding to One Rotation)} \quad (2)$$

Satisfying Equation 1 enables removal of the negatively charged toner adhering to the surface of the secondary transfer roller by retransferring the toner onto the intermediate transfer belt 10 over the entire circumference of the secondary transfer roller. Furthermore, satisfying Equation 2 enables removal of the positively charged toner by retransferring the toner onto the intermediate transfer belt 10 over the entire circumference of the secondary transfer roller.

In the trailing-end borderless printing, how much the inter-sheet area is to be increased compared with the normal printing, in which trailing-end borderless printing is not performed, to enable cleaning the entire circumference of the secondary transfer roller depends on the switching time of the secondary transfer roller 22. The inter-sheet area needs to be increased by at least a distance corresponding to two rotations of the secondary transfer roller or more compared with the normal printing.

While the number of times of switching of the secondary transfer bias between negative and positive in the inter-sheet area in the trailing-end borderless printing is six in total, it is not limited thereto. In other words, the negative secondary transfer bias simply needs to be applied for a time corresponding to one rotation of the secondary transfer roller or more, and the positive secondary transfer bias simply needs to be applied for a time corresponding to one rotation of the secondary transfer roller or more while the secondary transfer roller 22 is in contact with the intermediate transfer belt 10. As long as this condition is satisfied, the number of times of switching of the secondary transfer bias between negative and positive is not restricted.

The embodiment described above is given just as an example. The present invention has specific advantageous effects in each of the following aspects.

Aspect A

An image forming apparatus, such as a printer, includes an image carrier, a transfer member, and a non-transferred toner adhesion unit. The image carrier, such as the intermediate transfer belt 10, is rotatably provided and carries a toner image on a surface thereof. The transfer member, such as the secondary transfer roller 22, is arranged so as to face the image carrier. The non-transferred toner adhesion unit causes a non-transferred toner not to be transferred onto a sheet to adhere to an inter-sheet area present on the image carrier during a period of continuous image formation for continuously forming images. The transfer member is a foam roller. The image forming apparatus further includes a contacting and separating unit, such as the secondary transfer contacting and separating mechanism 70, that causes the foam roller and the image carrier to come into contact with and be separated from each other. The contacting and separating unit separates the image carrier and the transfer member when the inter-sheet area present on the image carrier passes through a transfer area in which the image carrier and the transfer member face each other in association with rotation of the image carrier. This makes it possible to suppress generation of an abnormal image caused by vibration caused by a collision of the sheet with the transfer member and to prevent a stain on the back of the sheet caused by the non-transferred toner adhering to the inter-sheet area on the image carrier as described in the embodiment.

Aspect B

Starting from Aspect A, the contacting and separating unit, to form an image on a specific sheet, brings the transfer member and the image carrier into the same separated state as a separated state in the inter-sheet area in the continuous image formation, before the leading end of the specific sheet enters the transfer area, and brings the transfer member and the image carrier into a contact state after the leading end of the specific sheet enters the transfer area. This causes the transfer member and the image carrier to be separated from each other when the specific sheet enters the transfer area, thereby preventing the leading end of the specific sheet from colliding with an entrance of the transfer area as described in the first embodiment. Thus, it is possible to prevent vibration caused by the collision from being transmitted to the image carrier and prevent the image quality from being deteriorated.

Aspect C

Starting from Aspect A or Aspect B, the image forming apparatus further includes a transfer bias applying unit, such as the secondary transfer bias applying power source 90, that applies a transfer bias to form a transfer electric field for transferring a toner image on the image carrier onto the sheet in the transfer area. The transfer bias applying unit applies a bias with a polarity opposite to that in normal image formation while the contacting and separating unit separates the transfer member and the image carrier from each other when the inter-sheet area passes through the transfer area in the continuous image formation. This makes a toner less likely to fly from the image carrier to the transfer member, thereby preventing a toner stain on the transfer member as described in the first embodiment.

Aspect D

Starting from Aspect C, constant voltage control is performed on the transfer bias applied by the transfer bias applying unit while the transfer member and the image carrier are separated from each other. This makes it possible to keep the toner from flying to the transfer member and to prevent troubles associated with an abnormal rise in voltage as described in the embodiment.

Aspect E

Starting from any one of Aspect A to Aspect D, the non-transferred toner adhesion unit forms a toner pattern for density adjustment control as the non-transferred toner. The image forming apparatus includes a toner adhesion amount detecting unit and a density adjustment control unit. The toner adhesion amount detecting unit, such as the toner adhesion amount sensor 5, detects the amount of toner adhering to respective toner patches constituting the toner pattern. The density adjustment control unit, such as the density adjustment control unit 80, performs density adjustment control of an image based on the result of the detection performed by the toner adhesion amount detecting unit. This makes it possible to stabilize the image density in the continuous image formation as described in the embodiment. Furthermore, the toner pattern causes no stain on the back of the sheet.

Aspect F

Starting from any one of Aspect A to Aspect E, the non-transferred toner adhesion unit forms a toner consumption pattern to replace the toner accommodated in the non-transferred toner adhesion unit, as the non-transferred toner. This makes it possible to refresh a deteriorated toner with a new toner and to stabilize the image quality as described in the embodiment. Furthermore, the toner consumption pattern causes no stain on the back of the sheet.

Aspect G

Starting from any one of Aspect A to Aspect F, the image forming apparatus has a normal mode for performing normal image formation and a special mode for performing special image formation different from the normal image formation. The normal mode and the special mode are selectable by an operator. If the special mode is selected, the contacting and separating unit does not separate the transfer member and the image carrier from each other, thereby bringing them into a contact state in the inter-sheet area in the continuous image formation, and the non-transferred toner adhesion unit does not cause non-transferred toner to adhere to the inter-sheet area on the image carrier. This makes it possible to remove the toner on the surface of the transfer member by transferring the toner from the transfer member to the image carrier in the inter-sheet area as described in the embodiment. Furthermore, if the special mode is selected, no adhesion of the non-transferred toner to the inter-sheet area can prevent the non-transferred toner from causing a toner stain on the transfer member.

Aspect H

Starting from Aspect G, if the special mode is selected, a bias with a polarity opposite to that applied in transfer of an image from the image carrier to the sheet is applied as the transfer bias in the inter-sheet area in the continuous image formation. This causes the toner to readhere from the surface of the transfer member to the image carrier in the inter-sheet area, thereby removing the toner adhering to the surface of the transfer member as described in first embodiment. Thus, it is possible to prevent a stain on the back of the sheet.

Aspect I

Starting from Aspect G, if the special mode is selected, a bias with the same polarity as that applied in transfer of an image from the image carrier to the sheet and a bias with a polarity opposite thereto are applied alternately as the transfer bias in the inter-sheet area in the continuous image formation. This causes a toner charged with the same polarity and a toner charged with the reverse polarity to readhere from the surface of the transfer member to the image carrier in the inter-sheet area, thereby removing the toners adhering to the surface of the transfer member as described in the embodiment. Thus, it is possible to prevent a stain on the back of the sheet.

Aspect J

Starting from any one of Aspect G to Aspect I, the special mode is borderless printing mode for forming a toner image to an edge of the sheet such that there is no margin at edges of the entire perimeter of the sheet or any of the edges of the sheet. In the borderless printing mode, the image protruding from the sheet adheres to the transfer member. As a result, even if the transfer member and the image carrier are separated from each other in the inter-sheet area, the transfer member is stained with the toner as described in the embodiment. To address this, the toner is caused to readhere from the surface of the transfer member to the image carrier in the inter-sheet area without separating the transfer member and the image carrier from each other in the inter-sheet area, thereby removing the toner adhering to the surface of the transfer member. Thus, it is possible to prevent a stain on the back of the sheet.

Aspect K

Starting from any one of Aspect G to Aspect J, the width of the inter-sheet area in a direction of rotation of the image carrier is larger in the special mode than in the normal mode. This makes it possible to remove the toner adhering to the surface of the transfer member more reliably as described in the embodiment.

Aspect L

Starting from Aspect K, the width of the inter-sheet area in the direction of rotation of the image carrier is set equal to or larger than twice the circumference of the foam roller in the special mode. If the toner charged with the same polarity and the toner charged with the reverse polarity are present on the surface of the transfer member, it is preferable that the bias with the same polarity and the bias with the reverse polarity be alternately applied each for a time corresponding to one rotation of the roller or more as described in the first embodiment. Setting the width of the inter-sheet area to equal to or larger than twice the circumference of the foam roller makes it possible to remove the toner charged with the same polarity and the toner charged with the reverse polarity more reliably.

Aspect M

Starting from any one of Aspect A to Aspect F, the toner image is formed to a trailing end of the sheet such that there is no margin at an edge on the trailing end of the sheet in a sheet conveying direction. This makes it possible to prevent a stain on the back of the sheet caused by a stain on the transfer member caused by the toner protruding from the trailing end of the sheet as described in the embodiment.

Aspect N

Starting from Aspect M, the image forming apparatus has a first image forming mode for forming the toner image on the sheet such that there is a margin at each edge of the entire perimeter of the sheet and a second image forming mode for forming the toner image to the trailing end of the sheet such that there is no margin at the edge at the trailing end of the sheet. The width of the inter-sheet area in the direction of rotation of the image carrier is increased in image formation in the second image forming mode compared with image formation in the first image forming mode. This makes it possible to remove the toner adhering to the surface of the transfer member more reliably as described in the embodiment.

Aspect O

Starting from Aspect N, the width of the inter-sheet area in the direction of rotation of the image carrier is increased in the image formation in the second image forming mode compared with the image formation in the first image forming mode by the circumference of the foam roller or more. This makes it possible to secure a time for causing the toner adhering to the transfer member to readhere from the surface of the transfer member to the image carrier in the inter-sheet area and removing the toner from the entire circumference of the transfer member as described in the first embodiment. Thus, it is possible to prevent a stain on the back of the sheet more reliably.

Aspect P

Starting from Aspect O, in the image formation in the second image forming mode, a time during which the foam roller is in contact with the image carrier, and a bias with the polarity opposite to that in the first image forming mode is applied in the inter-sheet area is set to at least equal to or longer than a time required for the foam roller to rotate once. This makes it possible to remove the toner with the reverse polarity from the entire circumference of the transfer member more reliably as described in the embodiment.

Aspect Q

Starting from Aspect N, the width of the inter-sheet area in the direction of rotation of the image carrier is increased in the image formation in the second image forming mode compared with the image formation in the first image forming mode by twice the circumference of the foam roller or more. This makes it possible to secure a time for removing the toner adhering to the transfer member from the entire circumference of the transfer member more reliably as described in the embodiment. Thus, it is possible to prevent a stain on the back of the sheet more reliably.

Aspect R

Starting from Aspect O or Aspect Q, in the image formation in the second image forming mode, a time during which the foam roller is in contact with the image carrier, and a bias with the polarity opposite to that in the first image forming mode is applied in the inter-sheet area is set to at least equal to or longer than a time required for the foam roller to rotate once. Furthermore, a time during which the foam roller comes into contact with the image carrier, and a bias with the same polarity as that in the first image forming mode is applied is set to at least equal to or longer than a time required for the foam roller to rotate once. This makes it possible to remove the toner with the same polarity and the toner with the reverse polarity from the entire circumference of the transfer member more reliably as described in the embodiment.

Aspect S

Starting from any one of Aspect A to Aspect R, the foam roller is formed of a foam member made of an NBR rubber or the like and having Asker C hardness of 60 degrees or more. This makes it possible to reduce occurrence of jitter as described in the embodiment.

Aspect T

Starting from Aspect S, the Asker C hardness of the foam member is equal to or lower than 45 degrees. This makes it possible to reduce jitter to a level at which jitter is not visually detected as described in the embodiment.

Aspect U

Starting from any one of Aspect A to Aspect T, the transfer member is driven to rotate by a driving mechanism different from that for the image carrier. With this configuration, driving force supplied from a driving source provided to the driving mechanism for the transfer member assists rotational drive of the image carrier when a piece of thick paper serving as the sheet enters a transfer nip as described in the embodiment. This can reduce fluctuations in speed of the image carrier. Thus, it is possible to reduce shock jitter occurring in association with fluctuations in speed of the image carrier.

Aspect V

Starting from any one of Aspect A to Aspect U, the contacting and separating unit performs two or more separating operations for separating the image carrier and the transfer member from each other with different clearances between the image carrier and the transfer member. The contacting and separating unit separates the image carrier and the transfer member also in a normal separation period, which is a period of separation other than separation in the inter-sheet area in the continuous image formation. A clearance between the image carrier and the transfer member is made smaller in separation of the image carrier and the transfer member in the inter-sheet area in the continuous image formation than in separation of the image carrier and the transfer member in the normal separation period. This makes it possible both to prevent adhesion of a non-transferred toner to the transfer member and to increase the speed of the contacting and separating operation as described in the embodiment. Furthermore, it is possible to keep a toner forcedly ejected just after the continuous image formation is finished from adhering to the transfer member.

Aspect W

Starting from Aspect V, in a contacting operation for shifting the state of the image carrier and the transfer member from the respective separated states achieved by the two or more separating operations to a contact state, the contacting and separating unit shifts the state from the respective separated states to the contact state by a single operation. Furthermore, in the separating operations for shifting the state of the image carrier and the transfer member from the contact state to the respective separated states, the contacting and separating unit shifts the state to the respective separated states by a single operation. This enables the contacting and separating unit to achieve the advantageous effects according to Aspect V with a simple configuration as described in the embodiment.

Aspect X

Starting from Aspect W, the contacting and separating unit includes a cam member and a rotational driving unit. The cam member, such as the contacting and separating cam 72, is arranged such that its cam face comes into contact with a cam contact position provided to the transfer member. The rotational driving unit, such as the contacting and separating motor, rotates the cam member to a predetermined rotational position. This enables the contacting and separating unit to achieve the advantageous effects according to Aspect W with a simple configuration as described in the embodiment.

Second Embodiment

An explanation will be made of an image forming apparatus that can prevent a stain on the back of a sheet caused by a toner protruding from an edge of a sheet and a non-transferred toner adhering to an inter-sheet area on an image carrier in a second embodiment according to the present invention.

The second embodiment will be described based on the same configuration as that of the image forming apparatus according to the first embodiment.

Because bordered printing and borderless printing are the same as those illustrated in FIGS. 6A to 6C, duplicate explanation thereof will be omitted.

In the same manner as in the description above, the present embodiment uses a roller member obtained by covering a metal cored bar with a rubber layer as a secondary transfer roller 22. While the material of the rubber layer is not particularly restricted, an NBR rubber is used in the present embodiment. Alternatively, a foam roller may be used.

Figure 21A:
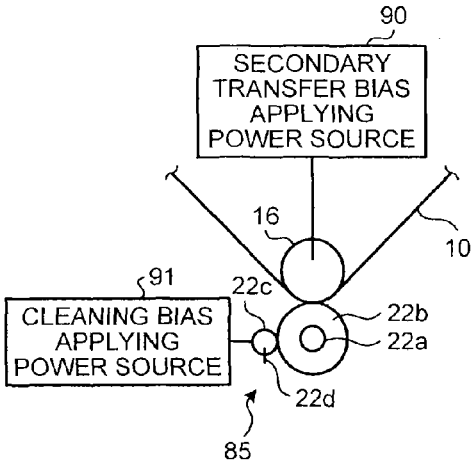
FIGS. 21A and 21B are schematics of a secondary transfer cleaning configuration and obtained by enlarging a secondary transfer area.
Figure 21B:
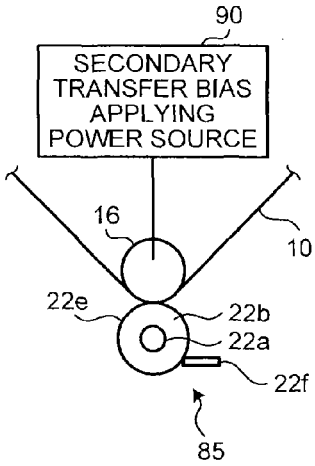

FIGS. 21A and 21B are schematics of a secondary transfer roller cleaning device 85. FIG. 21A and FIG. 21B are views for explaining two aspects of the secondary transfer roller cleaning device 85 but it is not intended to limit the configuration of the secondary transfer roller cleaning device 85.

FIG. 21A illustrates an example of the secondary transfer roller cleaning device 85 that cleans the surface of the secondary transfer roller 22 with a brush member. The secondary transfer roller 22 is obtained by forming a secondary transfer roller rubber layer 22*b* around a secondary transfer roller cored bar 22*a*.

The secondary transfer roller cleaning device 85 includes a cleaning brush roller 22*c* that is provided in a rotatable manner and cleans the surface of the secondary transfer roller 22. The secondary transfer roller cleaning device 85 further includes a cleaning bias applying power source 91 and a flicker 22*d*. The cleaning bias applying power source 91 applies a cleaning bias to the cleaning brush roller 22*c*. The flicker 22*d* flicks a toner accumulating on the cleaning brush roller 22*c*.

The cleaning brush roller 22*c* is in contact with the surface of the secondary transfer roller 22 with its brush dug into the surface by a predetermined amount. Rotation of the cleaning brush roller 22*c* causes the brush to rub the surface of the secondary transfer roller 22. The cleaning bias applying power source 91 applies a bias with the positive polarity opposite to the negative polarity, which is the normal charging polarity of the toner, to the cleaning brush roller 22*c*. This causes the cleaning brush roller 22*c* to attract the negatively charged toner adhering to the surface of the secondary transfer roller 22 with an electrostatic force. Thus, the cleaning brush roller 22*c* removes the toner adhering to the surface of the secondary transfer roller 22 from the surface of the secondary transfer roller 22 with a mechanical force generated by a rub of the brush and an electrostatic force generated by the cleaning bias.

The toner accumulating on the cleaning brush roller 22*c* is flicked off by the flicker 22*d* and is conveyed to a waste toner container, which is not illustrated.

FIG. 21B illustrates an example of the secondary transfer roller cleaning device 85 that cleans the surface of the secondary transfer roller 22 with a blade member. The secondary transfer roller 22 is obtained by forming the secondary transfer roller rubber layer 22*b* and a secondary transfer roller surface layer 22*e* around the secondary transfer roller cored bar 22*a*.

The secondary transfer roller cleaning device 85 includes a cleaning blade 22*f* that is a rubber blade member brought into contact with the surface of the secondary transfer roller 22. In association with rotation of the secondary transfer roller 22, the toner adhering to the surface of the secondary transfer roller 22 is scraped off by the cleaning blade 22*f*. The toner scraped off by the secondary transfer roller surface layer 22*e* and the cleaning blade 22*f* is conveyed to the waste toner container, which is not illustrated.

The secondary transfer roller surface layer 22*e* is formed on the surface of the secondary transfer roller 22 unlike the secondary transfer roller 22 illustrated in FIG. 21A because of the following reason. The rubber surface of the secondary transfer roller rubber layer 22*b* or the like typically has a high coefficient of friction. Therefore, if a typical rubber blade member is used as the cleaning blade 22*f*, frictional force generated between the secondary transfer roller rubber layer 22*b* and the cleaning blade 22*f* tends to cause turn-up of the cleaning blade 22*f*. Such turn-up of the cleaning blade 22*f* may possibly lead to poor cleaning. To address this, the surface of the secondary transfer roller rubber layer 22*b* is covered with the secondary transfer roller surface layer 22*e* having a coefficient of friction lower than that of the secondary transfer roller rubber layer 22*b*. This suppresses turn-up of the cleaning blade 22*f*, thereby suppressing poor cleaning. A metal blade member may be used as the cleaning blade 22*f*.

The configuration and the operation of a secondary transfer contacting and separating mechanism 70 that separates the secondary transfer roller 22 from an intermediate transfer belt 10 are the same as those illustrated in FIG. 8. Therefore, duplicate explanation thereof will be omitted.

In the present embodiment, when an inter-sheet area in which a toner pattern TP is formed on the intermediate transfer belt 10 passes through a secondary transfer area, the secondary transfer contacting and separating mechanism 70 separates the secondary transfer roller 22 from the intermediate transfer belt 10. Before a subsequent sheet enters the secondary transfer area, the secondary transfer contacting and separating mechanism 70 brings the secondary transfer roller 22 into contact with the intermediate transfer belt 10.

Contents of control of an operation for contacting and separating the secondary transfer roller 22 in bordered printing in the present embodiment are the same as those illustrated in FIGS. 9A to 9C.

In the present embodiment, the toner pattern TP is formed in an area between toner images on the intermediate transfer belt 10 at a predetermined timing in continuous printing. A toner adhesion amount sensor 5 then detects the toner pattern TP, and process control (density adjustment control) is performed. When the toner pattern TP formed on the intermediate transfer belt 10 passes through the secondary transfer area, no sheet P is present in the secondary transfer area. If the secondary transfer roller 22 remains in contact with the intermediate transfer belt 10, the toner pattern TP comes into contact with the surface of the secondary transfer roller 22 and adheres thereto. The toner adhering to the surface of the secondary transfer roller 22 is transferred from the secondary transfer roller 22 onto a sheet subsequently fed into the secondary transfer area, thereby causing a stain on the back of the sheet.

To address this, a control unit, which is not illustrated, controls a contacting and separating motor of a contacting and separating cam 71, thereby performing contacting and separating control illustrated in FIGS. 9A to 9C in the present embodiment. During a toner pattern passing period (a non-transferred toner passing period) in which the toner pattern TP is passing through the secondary transfer area, the secondary transfer roller 22 and the intermediate transfer belt 10 are separated from each other.

Specifically, in the same manner as in the operation described above, the secondary transfer roller 22 is first brought into contact with the intermediate transfer belt 10 as illustrated in FIG. 7A. Subsequently, a toner image just before formation of the toner pattern TP is secondarily transferred onto a preceding sheet P1 in the secondary transfer area. After the trailing end of the preceding sheet P1 passes through the secondary transfer area, the control unit controls the contacting and separating motor of the contacting and separating cam 71, thereby causing the contacting and separating cam 71 to start to rotate (time A in FIG. 1). At this time, the timing at which the contacting and separating cam 71 starts to rotate is set as follows: before the leading end of the toner pattern TP enters the secondary transfer area, the contacting and separating cam 71 completes a half turn, thereby separating the secondary transfer roller 22 from the intermediate transfer belt 10 as illustrated in FIG. 7B (time B in FIG. 1). After the trailing end of the toner pattern TP passes through the secondary transfer area, the control unit controls the contacting and separating motor of the contacting and separating cam 71, thereby causing the contacting and separating cam 71 to start to rotate (time C in FIG. 1). At this time, the timing at which the contacting and separating cam 71 starts to rotate is set as follows: before the leading end of a following sheet P2 enters the secondary transfer area, the contacting and separating cam 71 completes a half turn, thereby bringing the secondary transfer roller 22 into contact with the intermediate transfer belt 10 as illustrated in FIG. 7A (time D in FIG. 1).

Figure 22:
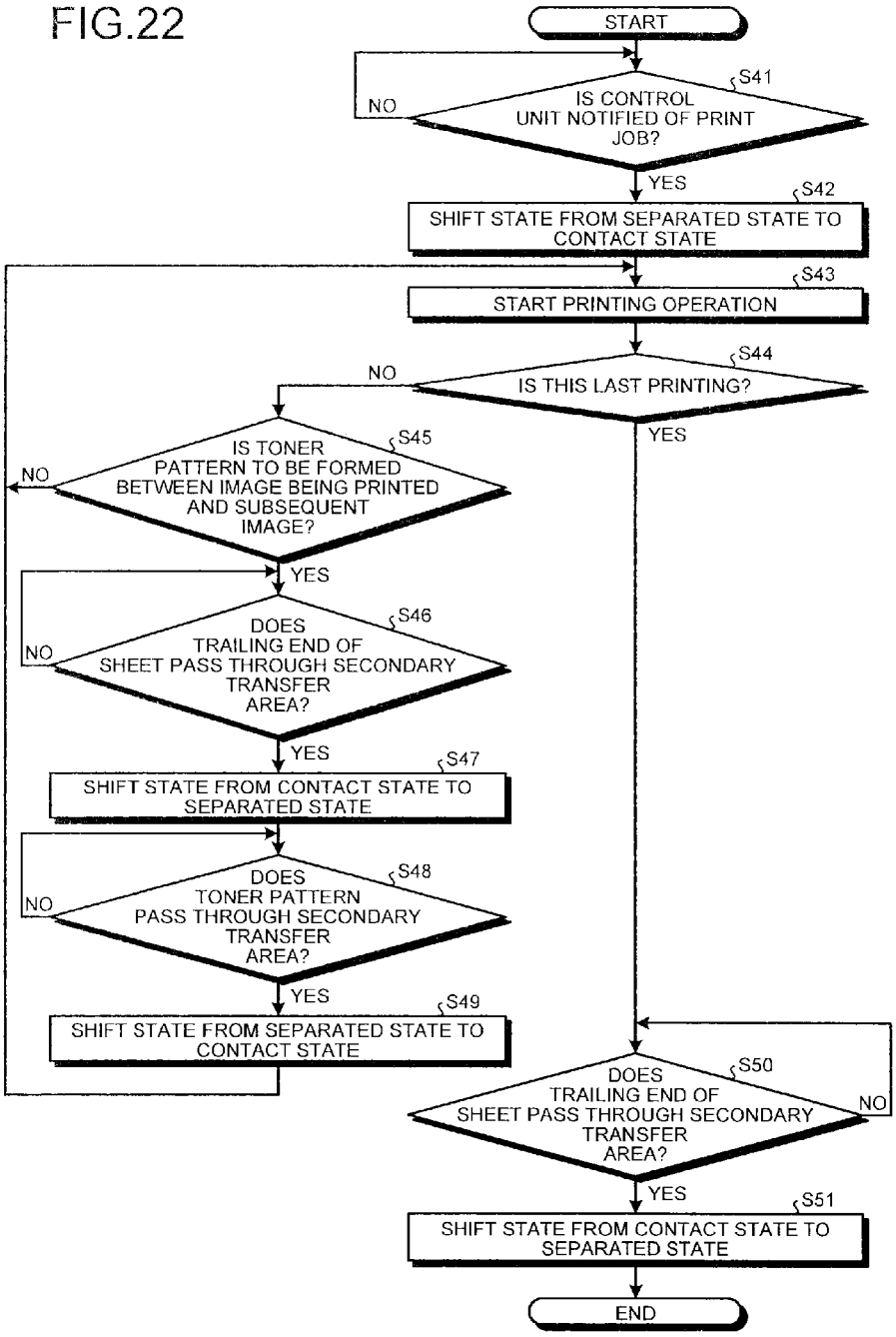
FIG. 22 is a flowchart for explaining a process of contacting and separating control of the secondary transfer roller according to the second embodiment.

The following describes an example of contacting and separating control of the secondary transfer roller 22. FIG. 22 is a flowchart for explaining a process of the contacting and separating control of the secondary transfer roller 22.

If the control unit is notified of a print job (Yes at Step S41), the contacting and separating cam 71 is caused to make a half turn and shifted from the separated state illustrated in FIG. 7B to the contact state illustrated in FIG. 7A before the timing at which the sheet P enters the secondary transfer area (Step S42). A printing operation for the sheet P is then started (Step S43). Subsequently, if there is no image to be subsequently printed and this is the last printing (Yes at Step S44), after the trailing end of the sheet P passes through the secondary transfer area (Step S50), the contacting and separating cam 71 is caused to make a half turn and shifted from the contact state illustrated in FIG. 7A to the separated state illustrated in FIG. 7B (Step S51).

By contrast, if there is a subsequent image to be printed (No at Step S44), it is determined whether to form the toner pattern TP between the image being printed and the subsequent image (Step S45). If it is determined to form no toner pattern TP (No at Step S45), a printing operation for the subsequent image is started at a predetermined timing as usual. At this time, while the area between the image being printed and the subsequent image (inter-image area) is passing through the secondary transfer area, the secondary transfer roller 22 remains in contact with the intermediate transfer belt 10. This enables the color copier to set the time in which the inter-image area passes through the secondary transfer area to as short a time as possible without being restricted by the speed of the contacting and separating operation of the secondary transfer contacting and separating mechanism.

If it is determined to form the toner pattern TP in the subsequent inter-sheet area (Yes at Step S45), the control unit waits until the trailing end of the sheet P passes through the secondary transfer area (Step S46). Subsequently, the contacting and separating cam 71 is caused to make a half turn and shifted from the contact state illustrated in FIG. 7A to the separated state in FIG. 7B before the timing at which the toner pattern TP enters the secondary transfer area (Step S47). After waiting until the trailing end of the toner pattern TP passes through the secondary transfer area (Step S48), the contacting and separating cam 71 is caused to make a half turn and shifted from the separated state illustrated in FIG. 7B to the contact state illustrated in FIG. 7A before the timing at which the subsequent sheet P enters the secondary transfer area (Step S49). Subsequently, a printing operation for the subsequent image is started at a predetermined timing. At this time, while the toner pattern TP formed in the area between the image being printed and the subsequent image (inter-image area) is passing through the secondary transfer area, the secondary transfer roller 22 remains separated from the intermediate transfer belt 10. Thus, the toner pattern TP does not come into contact with the secondary transfer roller 22. This prevents a stain on the back of a sheet caused by adhesion of the toner of the toner pattern TP to the back of a subsequent sheet via the secondary transfer roller 22.

Figure 20:
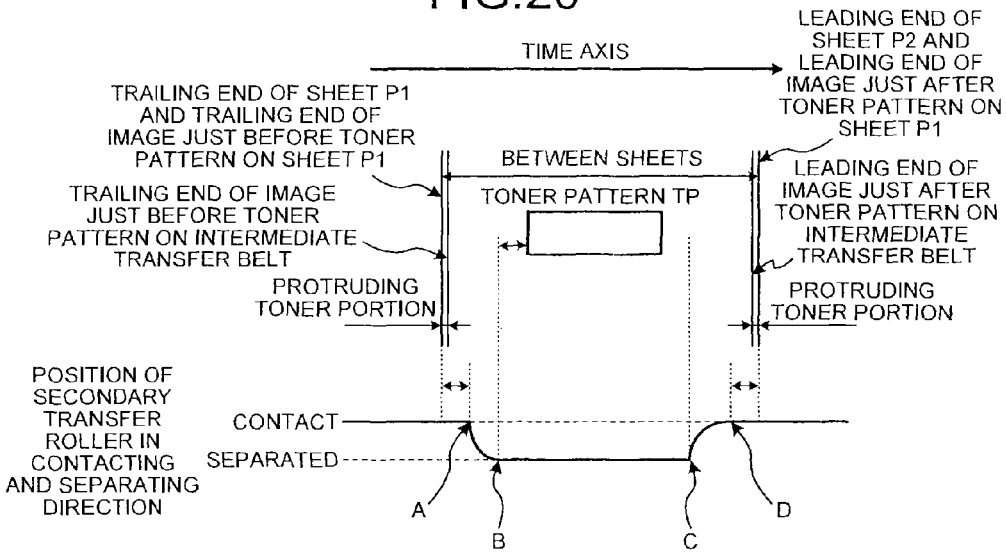
FIG. 20 is a view for explaining contents of control of an operation for contacting and separating a secondary transfer roller in borderless printing according to a second embodiment of the present invention.

FIG. 20 is a view for explaining contents of control of the operation for contacting and separating the secondary transfer roller 22 in borderless printing according to the second embodiment. FIG. 20 illustrates timings at which the sheet P, the toner image, and the toner pattern TP pass through the secondary transfer area and timings for contacting and separating the secondary transfer roller 22, with time on the horizontal axis.

Figure 23:
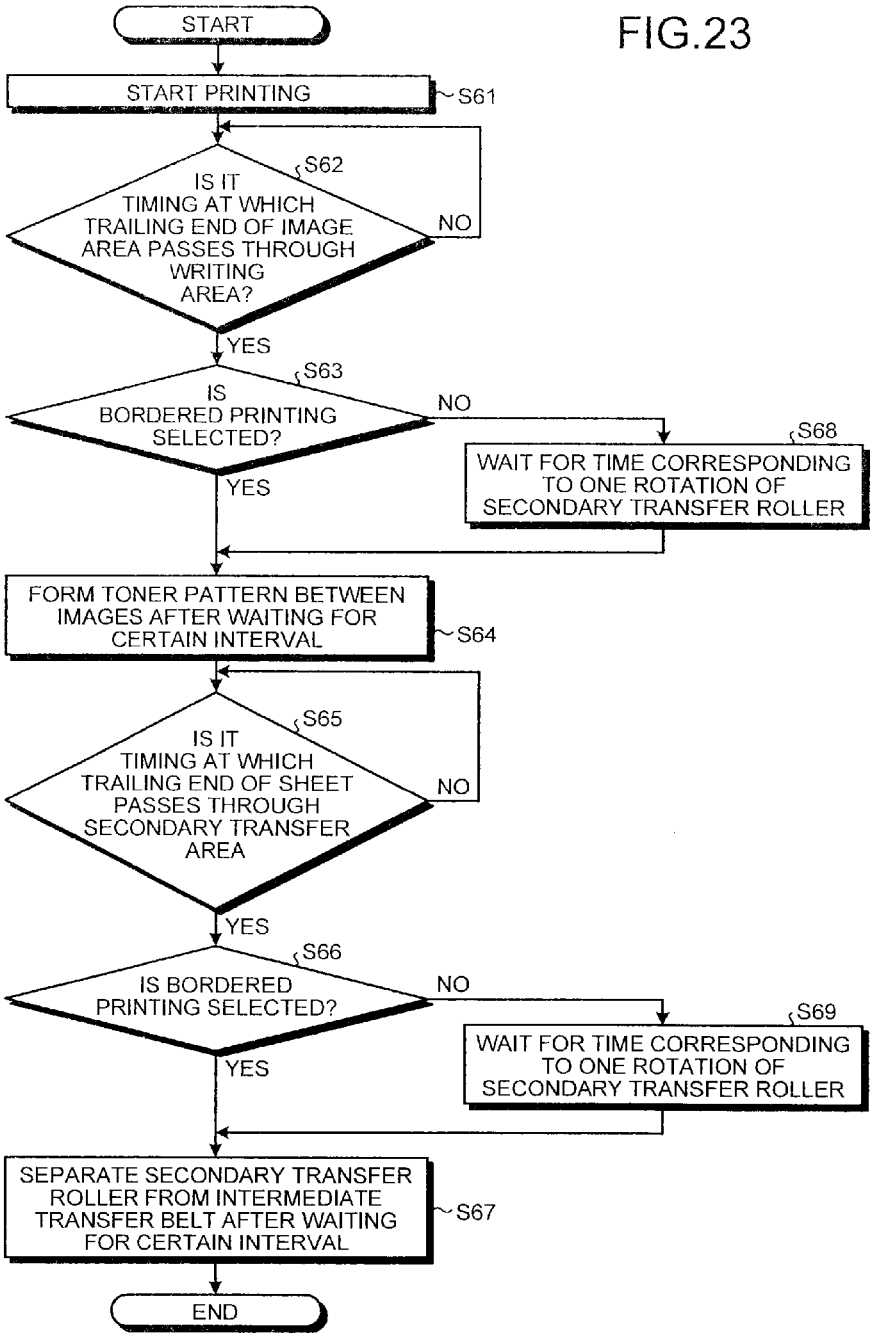
FIG. 23 is a flowchart of an example of control in bordered printing and borderless printing according to the second embodiment.

FIG. 23 is a flowchart of an example of control from the start of printing to the contacting and separating operation in the secondary transfer area in bordered printing and borderless printing.

After the printing is started (Step S61), it is determined whether it is a timing at which the trailing end of an image area on a photosensitive element 40 passes through a writing area (Step S62). If it is determined that the trailing end of the image area passes through the writing area (Yes at Step S62), it is determined whether bordered printing is selected (Step S63). Selection of bordered printing or borderless printing is performed by the operator pressing a button for switching between an image forming mode for carrying out bordered printing and an image forming mode for carrying out borderless printing in an operating unit provided to a copier main body 1, for example.

If bordered printing is selected (Yes at Step S63), the toner pattern TP is formed in the inter-sheet area on the photosensitive element 40 after a certain interval after the trailing end of the image area (Step S64).

In the formation of the toner pattern TP in the inter-sheet area, the certain interval is provided after the trailing end of the image area because of the following reason. If the toner pattern is present just after the trailing end of a sheet, the contacting and separating operation in the secondary transfer area fails to be carried out in time. As a result, the toner of the toner pattern TP may possibly adhere to the secondary transfer roller 22. To address this, it is necessary to form the toner pattern TP in the inter-sheet area after the interval required to complete separation of the secondary transfer roller 22 from the intermediate transfer belt 10 in the secondary transfer area after the trailing end of the image area.

By contrast, if borderless printing is selected (No at Step S63), an interval corresponding to one rotation of the secondary transfer roller is provided after the trailing end of the image area (Step S68). In addition, the toner pattern TP is formed in the inter-sheet area on the photosensitive element 40 further after a certain interval (Step S64).

Subsequently, it is determined whether it is a timing at which the trailing end of a sheet fed into the secondary transfer area passes through the secondary transfer area (Step S65). Because it is difficult to detect the trailing end of the sheet in the secondary transfer area, the determination can be made based on an elapsed time since a pair of registration rollers 49 that conveys the sheet to the secondary transfer area starts to be driven, for example.

If it is determined that the trailing end of the sheet passes through the secondary transfer area (Yes at Step S65) and bordered printing is selected (Yes at Step S66), the secondary transfer roller 22 is separated from the intermediate transfer belt 10 after a certain interval after the trailing end of the sheet passes through the secondary transfer area.

The secondary transfer roller 22 is separated from the intermediate transfer belt 10 after the certain interval because of a possibility of the following problem. If the separating operation in the secondary transfer area is carried out just after the trailing end of the sheet passes through the secondary transfer area, the separating operation may possibly be carried out while the sheet still remains in the secondary transfer area depending on fluctuations in the sheet conveyance timing. As a result, the image may possibly be deteriorated.

By contrast, if borderless printing is selected (No at Step S66), an interval corresponding to one rotation of the secondary transfer roller is provided after the trailing end of the sheet passes through the secondary transfer area, and the secondary transfer roller 22 is separated from the intermediate transfer belt 10 further after the certain interval.

The present embodiment delays the timing for forming the toner pattern TP in the inter-sheet area and the timing for separating the secondary transfer roller 22 from the intermediate transfer belt 10 between sheets in the borderless printing for at least a time corresponding to one rotation of the secondary transfer roller compared with the bordered printing.

In the borderless printing, similarly to the bordered printing, the control unit, which is not illustrated, controls the contacting and separating motor of the contacting and separating cam 71, thereby performing contacting and separating control illustrated in FIG. 20 in the present embodiment. During a patch passing period (a non-transferred toner passing period) in which the toner pattern TP is passing through the transfer area, the secondary transfer roller 22 and the intermediate transfer belt 10 are separated from each other.

Specifically, an operation similar to that described with reference to FIGS. 7A and 7B is carried out.

The toner protruding from the edge of the sheet in the borderless printing adheres to the intermediate transfer belt 10. When an image is transferred from the intermediate transfer belt 10 onto the sheet in the secondary transfer area, the protruding toner adheres from the intermediate transfer belt 10 to the surface of the secondary transfer roller 22, thereby causing a stain on the surface of the secondary transfer roller 22.

The secondary transfer roller cleaning device 85 provided with the blade member illustrated in FIG. 21B can clean the surface of the secondary transfer roller 22 by driving to rotate the secondary transfer roller 22 with a driving unit, such as a driving motor. In other words, even if the secondary transfer roller 22 is separated from the intermediate transfer belt 10, rotation of the secondary transfer roller 22 enables the cleaning blade 22*f* serving as a blade member to clean the secondary transfer roller 22.

By contrast, if the secondary transfer roller 22 is rotated not by the driving unit but in association with the rotation of the intermediate transfer belt 10, separation of the secondary transfer roller 22 from the intermediate transfer belt 10 causes the secondary transfer roller 22 to stop rotating. Stopping the rotation of the secondary transfer roller 22 causes the cleaning blade 221 to fail to scrape off the toner adhering to the surface of the secondary transfer roller 22. If the secondary transfer roller 22 is separated from the intermediate transfer belt 10 just after the trailing end of the sheet passes through the secondary transfer area, the secondary transfer roller 22 is brought into contact with the intermediate transfer belt 10 again with the surface thereof not being cleaned and being stained with the toner. As a result, if the following sheet P2 enters the secondary transfer area just after the secondary transfer roller 22 is brought into contact with the intermediate transfer belt 10, a stain on the back of the sheet and a stain on the edge surface are caused.

To address this, the timing for forming the toner pattern TP between sheets is delayed in the borderless printing compared with the bordered printing, and the timing for separating the secondary transfer roller 22 between sheets is also delayed. Thus, the secondary transfer roller 22 is separated from the intermediate transfer belt 10 after the cleaning device removes the toner adhering to the surface of the secondary transfer roller. This allows the toner pattern TP formed in the inter-sheet area on the intermediate transfer belt 10 to pass while the secondary transfer roller 22 is separated. As a result, it is possible to prevent both a stain on the back of the sheet caused by the protruding toner in borderless printing and a stain on the back of the sheet caused by the toner pattern TP formed in the inter-sheet area on the intermediate transfer belt 10.

In the borderless printing, similarly to the bordered printing, the secondary transfer roller 22 remains in contact with the intermediate transfer belt 10 while the inter-sheet area in which no toner pattern TP is formed on the intermediate transfer belt 10 is passing through the secondary transfer area. This enables the color copier to set the time in which the inter-sheet area passes through the secondary transfer area to as short a time as possible without being restricted by the speed of the contacting and separating operation of the secondary transfer contacting and separating mechanism. Thus, it is possible to prevent reduction in productivity.

The present embodiment separates the secondary transfer roller 22 from the intermediate transfer belt 10 also when an inter-sheet area of the intermediate transfer belt 10 to which a toner consumption pattern adheres passes through the secondary transfer area. The toner consumption pattern is formed to refresh the toner accommodated in a developing unit 61. This makes it possible to keep the toner of the toner consumption pattern from adhering to the surface of the secondary transfer roller 22 in the secondary transfer area, thereby preventing a stain on the back of the sheet.

The embodiment described above is given just as an example. The present invention has specific advantageous effects in each of the following aspects.

Aspect A

An image forming apparatus includes an image carrier, a transfer member, a sheet conveying unit, and a contacting and separating unit. On the image carrier, such as the intermediate transfer belt 10, a toner image is formed in accordance with image information. The transfer member, such as the secondary transfer roller 10, is arranged so as to face the image carrier. The sheet conveying unit, such as the pair of registration rollers 49, conveys a sheet such that the sheet passes through a transfer area, such as the secondary transfer area, in which the image carrier and the transfer member face each other. The contacting and separating unit, such as the secondary transfer contacting and separating mechanism 70, causes the transfer member and the image carrier to come into contact with and be separated from each other. The image forming apparatus can form a toner image to an end of the sheet such that there is no margin at edges of the entire perimeter of the sheet or any of the edges of the sheet. The image forming apparatus further includes a cleaning unit and a non-transferred toner adhesion unit. The cleaning unit, such as the secondary transfer roller cleaning device 85, cleans the surface of the transfer member. The non-transferred toner adhesion unit, such as the image forming unit 18, causes a non-transferred toner not to be transferred onto the sheet to adhere to an inter-sheet area among inter-sheet areas present on the image carrier during a period of continuous image formation for continuously forming images. The contacting and separating unit separates the transfer member from the image carrier when the inter-sheet area to which the non-transferred toner is caused to adhere by the non-transferred toner adhesion unit passes through the transfer area. This makes it possible to prevent a stain on the back of the sheet caused by a protruding toner in borderless printing and a non-transferred toner adhering to the inter-sheet area as described in the embodiment.

Aspect B

Starting from Aspect A, the image forming apparatus has a first image forming mode for forming the toner image on the sheet such that there is a margin at edges of the entire perimeter of the sheet and a second image forming mode for forming the toner image to an end of the sheet such that there is no margin at the edges of the entire perimeter of the sheet or any of the edges of the sheet. An adhesion timing at which the non-transferred toner adhesion unit causes the non-transferred toner to adhere to the inter-sheet area and a separation timing at which the contacting and separating unit separates the secondary transfer member from the image carrier are delayed in image formation in the second image forming mode compared with image formation in the first image forming mode. With this configuration, the transfer member is separated from the image carrier after the toner adhering to the surface of the transfer member in borderless printing is cleaned in the inter-sheet area as described in the embodiment. As a result, the toner pattern TP formed between the sheets can be passed while the transfer member is separated from the image carrier. Thus, it is possible to prevent a stain on the back of the sheet caused by the protruding toner in the borderless printing more reliably.

Aspect C

Starting from Aspect B, the transfer member is a roller member provided rotatably. The adhesion timing and the separation timing in the image formation in the second image forming mode are delayed for a time corresponding to one rotation of the transfer member compared with the image formation in the first image forming mode. This makes it possible to remove all the toner on the surface of the secondary transfer member and to prevent a stain on the back and the edge surface of a subsequent sheet reliably as described in the embodiment. Furthermore, minimization of extension of the distance between sheets can minimize reduction in the productivity.

Aspect D

Starting from any one of Aspect A to Aspect C, the image forming apparatus further includes a transfer bias applying unit, such as the secondary transfer bias applying power source 90, that applies a transfer bias to form a transfer electric field for transferring the toner image on the image carrier onto the sheet in the transfer area. The transfer bias applying unit applies a bias with a polarity opposite to that in normal printing while the contacting and separating unit separates the transfer member from the image carrier when the inter-sheet area to which the non-transferred toner is caused to adhere by the non-transferred toner adhesion unit passes through the transfer area. This makes a toner less likely to fly from the image carrier to the transfer member, thereby making it possible to prevent a toner stain on the transfer member as described in the embodiment.

Aspect E

Starting from Aspect D, constant voltage control is performed on the transfer bias applied by the transfer bias applying unit while the transfer member is separated from the image carrier. This makes it possible to keep the toner from flying to the transfer member and to prevent troubles associated with an abnormal rise in voltage as described in the embodiment.

Aspect F

Starting from any one of Aspect A to Aspect E, the non-transferred toner adhesion unit forms the toner pattern TP for density adjustment control as the non-transferred toner. The image forming apparatus includes a toner adhesion amount detecting unit and a density adjustment control unit. The toner adhesion amount detecting unit detects the amount of toner adhering to respective toner patterns TP constituting the toner pattern TP. The density adjustment control unit performs density adjustment control on an image based on the result of the detection performed by the toner adhesion amount detecting unit. This makes it possible to stabilize the image density in the continuous printing as described in the embodiment. Furthermore, the toner pattern TP makes no stain on the back of the sheet.

Aspect G

Starting from any one of Aspect A to Aspect E, the non-transferred toner adhesion unit forms a toner consumption pattern to replace the toner accommodated in the non-transferred toner adhesion unit, as the non-transferred toner. This makes it possible to refresh a deteriorated toner with a new toner and to stabilize the image quality as described in the second embodiment. Furthermore, the toner consumption pattern makes no stain on the back of the sheet.

The embodiment can prevent a stain on the back of a sheet caused by a non-transferred toner adhering to an inter-sheet area on an image carrier.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that is rotatably provided and carries a toner image on a surface thereof;

a transfer member arranged so as to face the image carrier; and a non-transferred toner adhesion unit that causes a non-transferred toner not to be transferred onto a sheet to adhere to an inter-sheet area present on the image carrier during a period of continuous image formation in which images are continuously formed on the image carrier, wherein:

the transfer member includes a foam roller, the image forming apparatus further comprises a contacting and separating unit that causes the transfer member and the image carrier to come into contact with and be separated from each other, the contacting and separating unit separates the image carrier and the transfer member when the inter-sheet area present on the image carrier passes through a transfer area in which the image carrier and the transfer member face each other in association with a rotation of the image carrier, the toner image is formed to a trailing end of the sheet such that there is no margin at an edge at the trailing end of the sheet in a sheet conveying direction, the image forming apparatus has a first image forming mode in which the toner image is formed on the sheet such that there is a margin at edges of an entire perimeter of the sheet and a second image forming mode in which the toner image is formed to the trailing end of the sheet such that there is no margin at the edge at the trailing end of the sheet, a width of the inter-sheet area in a direction of rotation of the image carrier is larger in image formation in the second image forming mode than in image formation in the first image forming mode by a length of a circumference of the transfer member or more, and in the image formation in the second image forming mode, a time during which the transfer member is in contact with the image carrier, and a bias with a polarity opposite to that in the first image forming mode is applied in the inter-sheet area is set to at least a time required for the transfer member to rotate once or more, and a time during which the transfer member is in contact with the image carrier, and a bias with a same polarity as that in the first image forming mode is applied is set to at least a time required for the transfer member to rotate once or more.

2. The image forming apparatus according to claim 1, wherein the contacting and separating unit, when forming an image on a specific sheet, brings the transfer member and the image carrier into a same separated state as a separated state in the inter-sheet area in the continuous image formation before a leading end of the specific sheet enters the transfer area, and brings the transfer member and the image carrier into a contact state after the leading end of the specific sheet enters the transfer area.

3. The image forming apparatus according to claim 1, further comprising:

a transfer bias applying unit that applies a transfer bias to form a transfer electric field to transfer the toner image on the image carrier onto the sheet in the transfer area, wherein the transfer bias applying unit applies a bias with a polarity opposite to that in normal image formation while the contacting and separating unit separates the transfer member and the image carrier when the inter-sheet area passes through the transfer area in the continuous image formation.

4. The image forming apparatus according to claim 3, wherein a constant voltage control is performed on the bias applied by the transfer bias applying unit while the transfer member and the image carrier are separated.

5. The image forming apparatus according to claim 1, wherein the image forming apparatus has the first image forming mode in which first image formation is performed and the second image forming mode in which second image formation different from the first image formation is performed, the first image forming mode and the second image forming mode are selectable by an operator, and when the second image forming mode is selected, the contacting and separating unit does not separate the transfer member and the image carrier and keeps the transfer member and the image carrier in a contact state in the inter-sheet area in the continuous image formation, and the non-transferred toner adhesion unit does not cause the non-transferred toner to adhere to the inter-sheet area on the image carrier.

6. The image forming apparatus according to claim 5, wherein the second image forming mode is a borderless printing mode in which the toner image is formed to an edge of a sheet such that there is no margin at edges of an entire perimeter of the sheet or any of the edges of the sheet.

7. The image forming apparatus according to claim 5, wherein the width of the inter-sheet area in the direction of rotation of the image carrier is larger in the second image forming mode than in the first image forming mode.

8. The image forming apparatus according to claim 7, wherein the width of the inter-sheet area in the direction of rotation of the image carrier is set equal to or larger than twice the circumference of the transfer member in the second image forming mode.

9. The image forming apparatus according to claim 1, wherein the contacting and separating unit performs two or more separating operations of separating the image carrier and the transfer member with different clearances between the image carrier and the transfer member, and separates the image carrier and the transfer member also in a normal separation period that is a period of separation other than separation in the inter-sheet area in the continuous image formation, and a clearance between the image carrier and the transfer member is smaller in separation of the image carrier and the transfer member in the inter-sheet area in the continuous image formation than that in separation of the image carrier and the transfer member in the normal separation period.

* * * * *